US010702736B2

(12) United States Patent
Weston et al.

(10) Patent No.: US 10,702,736 B2
(45) Date of Patent: Jul. 7, 2020

(54) EXERCISE CYCLE

(71) Applicant: ICON Health & Fitness, Inc., Logan, UT (US)

(72) Inventors: Jared Weston, Providence, UT (US); William T. Dalebout, North Logan, UT (US); Greg W. Law, Smithfield, UT (US); Keith A. Taylor, Plain City, UT (US); Steven J. Kresie, Nibley, UT (US); Eric S. Watterson, Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 38 days.

(21) Appl. No.: 15/870,206

(22) Filed: Jan. 12, 2018

(65) Prior Publication Data

US 2018/0200566 A1 Jul. 19, 2018

Related U.S. Application Data

(60) Provisional application No. 62/446,425, filed on Jan. 14, 2017.

(51) Int. Cl.
*A63B 22/06* (2006.01)
*A63B 71/06* (2006.01)
(Continued)

(52) U.S. Cl.
CPC ..... *A63B 22/0023* (2013.01); *A63B 22/0046* (2013.01); *A63B 22/0605* (2013.01);
(Continued)

(58) Field of Classification Search
CPC ..... A63B 22/0023; A63B 22/0046; A63B 22/0605; A63B 21/00192; A63B 21/015;
(Continued)

(56) References Cited

U.S. PATENT DOCUMENTS 1,577,866 A 3/1926 Mossberg
2,041,445 A 5/1936 Warren
(Continued)

FOREIGN PATENT DOCUMENTS

CN 103363001 10/2015
JP 10167158 6/1998
(Continued)

OTHER PUBLICATIONS

Elements of Comfort—Bicycle Saddle Dimensions [retrieved on May 15, 2019]. Retrieved from the Internet <url:https: web.archive. org="" web="" 20150310175008="" https:="" www.koobi.com="" technology-bicycle-saddle-base-dinnensions.html=""> (<URL:https://web.archive.org/web/20150310175008/https://www.koobi.com/.*
(Continued)

*Primary Examiner* — Loan B Jimenez
*Assistant Examiner* — Zachary T Moore
(74) *Attorney, Agent, or Firm* — Ray Quinney & Nebeker

(57) ABSTRACT

Embodiments relate to exercise systems, and more particularly to adjustable exercise cycles. In accordance with at least some aspects, a stationary exercise cycle includes an incline mechanism that adjusts an incline of an upright support structure. The incline mechanism is aligned with a portion of an upright support structure on which a handle bar assembly is mounted. In some cases, the exercise cycle includes a console that can be rotated for viewing when not riding on the exercise cycle. The exercise cycle can also include an adjustment mechanism for adjusting the position of a seat or the handle bar assembly. The adjustment mechanism can include a cam-based locking mechanism for selectively securing the seat or handle bar assembly in place.

20 Claims, 12 Drawing Sheets

(51) Int. Cl.

| | |
|---|---|
| ***A63B 21/22*** | (2006.01) |
| ***A63B 21/005*** | (2006.01) |
| ***A63B 23/04*** | (2006.01) |
| ***A63B 21/015*** | (2006.01) |
| ***A63B 22/00*** | (2006.01) |
| *A63B 24/00* | (2006.01) |
| *A63B 21/00* | (2006.01) |

(52) U.S. Cl.
CPC ..... *A63B 71/0622* (2013.01); *A63B 21/0051* (2013.01); *A63B 21/0058* (2013.01); *A63B 21/00192* (2013.01); *A63B 21/015* (2013.01); *A63B 21/225* (2013.01); *A63B 23/0476* (2013.01); *A63B 24/0087* (2013.01); *A63B 2071/0625* (2013.01); *A63B 2225/09* (2013.01)

(58) Field of Classification Search
CPC ..... A63B 21/0051; A63B 21/225; A63B 21/0058; A63B 71/0622; A63B 2225/09; A63B 24/0087; A63B 2071/0625; A63B 22/00; A63B 22/0015; A63B 22/06; A63B 22/0664; A63B 23/00; A63B 23/035; A63B 23/03516; A63B 23/03533; A63B 23/04; A63B 23/0405; A63B 23/0423; A63B 23/0476; A63B 23/0482; A63B 23/0494; A63B 2022/0635; A63B 2022/0647; A63B 2022/0652; A63B 69/16; A63B 21/00; A63B 21/0004; A63B 21/00047; A63B 21/00178; A63B 21/002; A63B 21/0023; A63B 21/005; A63B 21/012; A63B 21/4027; A63B 21/4033; A63B 21/4034; A63B 21/4035; A63B 21/4041; A63B 21/4045; A63B 21/4047; A63B 21/4049
See application file for complete search history.

(56) References Cited

U.S. PATENT DOCUMENTS

| | | | |
|---|---|---|---|
| 3,008,265 | A | 11/1961 | Converse |
| 3,100,640 | A | 8/1963 | Weitzel |
| 3,103,357 | A | 9/1963 | Berne |
| 3,190,675 | A | 6/1965 | Tang |
| 3,205,888 | A | 9/1965 | Stroop |
| 3,227,447 | A | 1/1966 | Baker |
| 3,323,366 | A | 6/1967 | De Lorme et al. |
| 3,425,523 | A | 2/1969 | Robinette |
| 3,432,164 | A | 3/1969 | Deeks |
| 3,506,311 | A | 4/1970 | Nobach |
| 3,528,653 | A | 9/1970 | Stuckenschneider et al. |
| 3,563,541 | A | 2/1971 | Sanquist |
| 3,572,700 | A | 3/1971 | Mastropaolo |
| 3,621,948 | A | 11/1971 | Dimick |
| 3,686,776 | A | 8/1972 | Dahl |
| 3,820,617 | A | 6/1974 | Groff |
| 3,833,216 | A | 9/1974 | Philbin |
| 3,903,613 | A | 9/1975 | Bisberg |
| 3,966,201 | A | 6/1976 | Mester |
| 3,967,503 | A | 7/1976 | Svensson |
| 3,990,136 | A | 11/1976 | Hishida |
| 4,007,927 | A | 2/1977 | Proctor |
| 4,045,096 | A | 8/1977 | Lidov |
| 4,049,262 | A | 9/1977 | Cunningham, Jr. |
| 4,138,286 | A | 2/1979 | Chevrolat et al. |
| 4,148,478 | A | 4/1979 | Moyski et al. |
| 4,151,988 | A | 5/1979 | Nabinger |
| 4,188,030 | A | 2/1980 | Hooper |
| 4,208,921 | A | 6/1980 | Keyes |
| 4,278,095 | A | 7/1981 | Lapeyre |
| 4,286,696 | A | 9/1981 | Szymski et al. |
| 4,290,601 | A | 9/1981 | Mittelstadt |
| 4,291,872 | A | 9/1981 | Brilando et al. |
| 4,505,473 | A | 3/1985 | Pro |
| 4,512,567 | A | 4/1985 | Phillips |
| 4,519,604 | A | 5/1985 | Arzounian |
| 4,533,136 | A | 8/1985 | Smith et al. |
| 4,588,232 | A | 5/1986 | Kim et al. |
| 4,589,656 | A | 5/1986 | Baldwin |
| 4,602,781 | A | 7/1986 | La Marsh et al. |
| 4,611,807 | A | 9/1986 | Castillo |
| 4,625,962 | A | 12/1986 | Street |
| 4,630,817 | A | 12/1986 | Buckley |
| 4,637,605 | A | 1/1987 | Ritchie |
| 4,645,199 | A | 2/1987 | Bloemendaal |
| 4,702,475 | A | 10/1987 | Elstein et al. |
| 4,709,917 | A | 12/1987 | Yang |
| 4,711,447 | A | 12/1987 | Mansfield |
| 4,720,099 | A | 1/1988 | Carlson |
| 4,720,789 | A | 1/1988 | Hector et al. |
| 4,726,582 | A | 2/1988 | Fulks |
| 4,741,578 | A | 5/1988 | Viellard |
| 4,743,009 | A | 5/1988 | Beale |
| 4,746,112 | A | 5/1988 | Fayal |
| 4,762,317 | A | 8/1988 | Camfield et al. |
| 4,786,069 | A | 11/1988 | Tang |
| 4,826,150 | A | 5/1989 | Minoura |
| 4,867,443 | A | 9/1989 | Jensen |
| 4,887,967 | A | 12/1989 | Letovsky et al. |
| 4,898,379 | A | 2/1990 | Shiba |
| 4,900,017 | A | 2/1990 | Bold, Jr. |
| 4,917,376 | A | 4/1990 | Lo |
| 4,917,377 | A | 4/1990 | Chen |
| 4,925,183 | A | 5/1990 | Kim |
| 4,932,651 | A | 6/1990 | Defaux |
| 4,938,474 | A | 7/1990 | Sweeney et al. |
| 4,938,475 | A | 7/1990 | Sargeant |
| 4,958,832 | A | 9/1990 | Kim |
| 4,977,794 | A | 12/1990 | Metcalf |
| 4,981,294 | A | 1/1991 | Dalebout et al. |
| 5,000,440 | A | 3/1991 | Lynch |
| 5,016,870 | A | 5/1991 | Bulloch et al. |
| RE33,662 | E | 8/1991 | Blair et al. |
| 5,062,633 | A | 11/1991 | Engel et al. |
| 5,081,991 | A | 1/1992 | Chance |
| 5,104,119 | A | 4/1992 | Lynch |
| 5,137,501 | A | 8/1992 | Mertesdorf |
| 5,139,255 | A | 8/1992 | Sollami |
| 5,161,652 | A | 11/1992 | Suzuki |
| 5,162,029 | A | 11/1992 | Schine |
| 5,171,196 | A | 12/1992 | Lynch |
| 5,178,589 | A | 1/1993 | Wilson |
| 5,234,392 | A | 8/1993 | Clark |
| 5,240,417 | A | 8/1993 | Smithson et al. |
| 5,242,343 | A | 9/1993 | Miller |
| 5,247,853 | A | 9/1993 | Dalebout |
| 5,256,117 | A | 10/1993 | Potts et al. |
| 5,261,864 | A | 11/1993 | Fitzpatrick |
| 5,277,678 | A | 1/1994 | Friedebach et al. |
| 5,299,993 | A | 4/1994 | Habing |
| 5,299,997 | A | 4/1994 | Chen |
| 5,302,161 | A | 4/1994 | Loubert et al. |
| 5,324,242 | A | 6/1994 | Lo |
| RE34,728 | E | 9/1994 | Hall-Tipping |
| 5,354,251 | A | 10/1994 | Sleamaker |
| 5,358,461 | A | 10/1994 | Bailey, Jr. |
| 5,362,069 | A | 11/1994 | Hall-Tipping |
| 5,372,564 | A | 12/1994 | Spirito |
| 5,374,227 | A | 12/1994 | Webb |
| 5,383,715 | A | 1/1995 | Homma et al. |
| 5,409,435 | A | 4/1995 | Daniels |
| RE34,959 | E | 5/1995 | Potts |
| 5,417,643 | A | 5/1995 | Taylor |
| 5,419,619 | A | 5/1995 | Lew |
| 5,423,729 | A | 6/1995 | Eschenbach |
| 5,431,612 | A | 7/1995 | Holden |
| 5,435,798 | A | 7/1995 | Habing et al. |
| 5,462,503 | A | 10/1995 | Benjamin et al. |
| 5,503,043 | A | 4/1996 | Olbrich |
| 5,512,029 | A | 4/1996 | Barnard |
| 5,514,053 | A | 5/1996 | Hawkins et al. |

(56) References Cited

U.S. PATENT DOCUMENTS

| | | | |
|---|---|---|---|
| 5,529,554 | A | 6/1996 | Eschenbach |
| 5,533,951 | A | 7/1996 | Chang |
| 5,542,503 | A | 8/1996 | Dunn et al. |
| 5,577,985 | A | 11/1996 | Miller |
| 5,580,249 | A | 12/1996 | Jacobsen et al. |
| 5,584,700 | A | 12/1996 | Feldman et al. |
| 5,584,779 | A | 12/1996 | Knecht |
| 5,591,104 | A | 1/1997 | Andrus et al. |
| 5,611,756 | A | 3/1997 | Miller |
| 5,626,401 | A | 5/1997 | Terry, Sr. et al. |
| 5,656,001 | A | 8/1997 | Baatz |
| 5,665,031 | A | 9/1997 | Hsieh |
| 5,665,032 | A | 9/1997 | Chen |
| 5,667,459 | A | 9/1997 | Su |
| 5,669,833 | A | 9/1997 | Stone |
| 5,685,804 | A | 11/1997 | Whan-Tong et al. |
| 5,690,582 | A | 11/1997 | Ulrich et al. |
| 5,692,994 | A | 12/1997 | Eschenbach |
| 5,708,355 | A | 1/1998 | Schrey |
| 5,709,631 | A | 1/1998 | Kleinsasser |
| 5,709,632 | A | 1/1998 | Socwell |
| 5,735,773 | A | 4/1998 | Vittone |
| 5,762,584 | A | 6/1998 | Daniels |
| 5,772,522 | A | 6/1998 | Nesbit |
| 5,782,639 | A | 7/1998 | Beal |
| 5,785,630 | A | 7/1998 | Bobick et al. |
| 5,788,609 | A | 8/1998 | Miller |
| 5,795,270 | A | 8/1998 | Woods et al. |
| 5,810,696 | A | 9/1998 | Webb |
| 5,826,898 | A | 10/1998 | Fortier et al. |
| 5,833,583 | A | 11/1998 | Chuang |
| 5,836,855 | A | 11/1998 | Eschenbach |
| 5,839,990 | A | 11/1998 | Virkkala |
| 5,848,954 | A | 12/1998 | Stearns et al. |
| 5,862,892 | A | 1/1999 | Conley |
| 5,868,108 | A | 2/1999 | Schmitz et al. |
| 5,878,479 | A | 3/1999 | Dickerson et al. |
| 5,884,735 | A | 3/1999 | Eckel et al. |
| 5,888,172 | A | 3/1999 | Andrus et al. |
| 5,890,995 | A | 4/1999 | Bobick et al. |
| 5,895,339 | A | 4/1999 | Maresh |
| 5,897,460 | A | 4/1999 | McBride et al. |
| 5,913,751 | A | 6/1999 | Eschenbach |
| 5,916,064 | A | 6/1999 | Eschenbach |
| 5,917,692 | A | 6/1999 | Schmitz et al. |
| 5,921,896 | A | 7/1999 | Boland |
| 5,938,551 | A | 8/1999 | Warner |
| 5,938,570 | A | 8/1999 | Maresh |
| 5,947,824 | A | 9/1999 | Minami et al. |
| 5,957,814 | A | 9/1999 | Eschenbach |
| 5,967,944 | A | 10/1999 | Vittone et al. |
| 5,984,839 | A | 11/1999 | Corkum |
| 5,989,161 | A | 11/1999 | Wang et al. |
| 5,989,163 | A | 11/1999 | Rodgers, Jr. |
| 5,991,143 | A | 11/1999 | Wright et al. |
| 6,003,481 | A | 12/1999 | Pischinger et al. |
| 6,014,913 | A | 1/2000 | Masahiro |
| 6,017,295 | A | 1/2000 | Eschenbach |
| 6,039,676 | A | 3/2000 | Clive |
| 6,045,488 | A | 4/2000 | Eschenbach |
| 6,053,847 | A | 4/2000 | Stearns et al. |
| 6,075,525 | A | 6/2000 | Hsieh |
| 6,090,014 | A | 7/2000 | Eschenbach |
| 6,126,573 | A | 10/2000 | Eschenbach |
| 6,142,870 | A | 11/2000 | Wada et al. |
| 6,142,913 | A | 11/2000 | Ewert |
| 6,142,915 | A | 11/2000 | Eschenbach |
| 6,164,423 | A | 12/2000 | Dickerson |
| 6,182,531 | B1 | 2/2001 | Gallagher et al. |
| 6,183,397 | B1 | 2/2001 | Stearns et al. |
| 6,186,290 | B1 | 2/2001 | Carlson |
| 6,210,305 | B1 | 4/2001 | Eschenbach |
| 6,217,486 | B1 | 4/2001 | Rosenow |
| 6,224,080 | B1 | 5/2001 | Ross |
| 6,234,938 | B1 | 5/2001 | Chen |
| 6,244,988 | B1 | 6/2001 | Delman |
| 6,254,514 | B1 | 7/2001 | Maresh et al. |
| 6,277,056 | B1 | 8/2001 | McBride et al. |
| 6,280,362 | B1 | 8/2001 | Dalebout et al. |
| 6,312,363 | B1 | 11/2001 | Watterson et al. |
| 6,361,476 | B1 | 3/2002 | Eschenbach |
| 6,361,477 | B1 | 3/2002 | Kolda |
| 6,397,797 | B1 | 6/2002 | Kolmanovsky et al. |
| 6,416,442 | B1 | 7/2002 | Stearns et al. |
| 6,419,611 | B1 | 7/2002 | Levine et al. |
| 6,422,976 | B1 | 7/2002 | Eschenbach |
| 6,447,424 | B1 | 9/2002 | Ashby et al. |
| 6,450,923 | B1 | 9/2002 | Vatti |
| 6,454,679 | B1 | 9/2002 | Radow |
| 6,458,060 | B1 | 10/2002 | Watterson et al. |
| 6,482,128 | B1 | 11/2002 | Michalow |
| 6,482,132 | B2 | 11/2002 | Eschenbach |
| 6,497,426 | B2 | 12/2002 | Vanpelt |
| 6,505,503 | B1 | 1/2003 | Teresi et al. |
| 6,530,864 | B1 | 3/2003 | Parks |
| 6,544,146 | B1 | 4/2003 | Stearns et al. |
| 6,547,702 | B1 | 4/2003 | Heidecke |
| 6,569,061 | B2 | 5/2003 | Stearns et al. |
| 6,572,511 | B1 | 6/2003 | Volpe |
| 6,592,502 | B1 | 7/2003 | Phillips |
| 6,604,008 | B2 | 8/2003 | Chudley et al. |
| 6,612,969 | B2 | 9/2003 | Eschenbach |
| 6,626,802 | B1 | 9/2003 | Rodgers, Jr. |
| 6,645,125 | B1 | 11/2003 | Stearns et al. |
| 6,647,826 | B2 | 11/2003 | Okajima et al. |
| 6,648,353 | B1 | 11/2003 | Cabal |
| 6,648,800 | B2 | 11/2003 | Stearns et al. |
| 6,681,728 | B2 | 1/2004 | Haghgooie |
| 6,689,019 | B2 | 2/2004 | Ohrt et al. |
| 6,695,694 | B2 | 2/2004 | Ishikawa et al. |
| 6,702,719 | B1 | 3/2004 | Brown et al. |
| 6,712,737 | B1 | 3/2004 | Nusbaum |
| 6,752,453 | B1 | 6/2004 | Yapp |
| 6,758,790 | B1 | 7/2004 | Ellis |
| 6,786,821 | B2 | 9/2004 | Nobe et al. |
| 6,786,848 | B2 | 9/2004 | Yamashita et al. |
| 6,786,850 | B2 | 9/2004 | Nizamuddin |
| 6,793,609 | B1 | 9/2004 | Fan |
| 6,824,502 | B1 | 11/2004 | Huang |
| 6,835,166 | B1 | 12/2004 | Stearns et al. |
| 6,837,829 | B2 | 1/2005 | Eschenbach |
| 6,840,892 | B1 | 1/2005 | Wu |
| 6,846,272 | B2 | 1/2005 | Rosenow et al. |
| 6,887,190 | B1 | 5/2005 | Azari |
| 6,902,513 | B1 | 6/2005 | Mcclure |
| 6,902,515 | B2 | 6/2005 | Howell et al. |
| 6,908,417 | B2 | 6/2005 | Jackson |
| 6,918,859 | B1 | 7/2005 | Yeh |
| 6,918,860 | B1 | 7/2005 | Nusbaum |
| 6,926,645 | B1 | 8/2005 | Stearns |
| 6,926,646 | B1 | 8/2005 | Nguyen |
| 6,932,745 | B1 | 8/2005 | Ellis |
| 6,945,917 | B1 | 9/2005 | Baatz |
| 6,994,656 | B2 | 2/2006 | Liao et al. |
| 7,022,047 | B2 | 4/2006 | Cohen et al. |
| 7,022,048 | B1 | 4/2006 | Fernandez |
| 7,044,891 | B1 | 5/2006 | Rivera |
| 7,060,005 | B2 | 6/2006 | Carlsen et al. |
| 7,060,006 | B1 | 6/2006 | Watterson et al. |
| 7,101,330 | B2 | 9/2006 | Elbaz et al. |
| 7,141,008 | B2 | 11/2006 | Krull et al. |
| 7,166,062 | B1 | 1/2007 | Watterson et al. |
| 7,169,088 | B2 | 1/2007 | Rodgers, Jr. |
| 7,169,089 | B2 | 1/2007 | Rodgers, Jr. |
| 7,172,531 | B2 | 2/2007 | Rodgers, Jr. |
| 7,201,705 | B2 | 4/2007 | Rodgers, Jr. |
| 7,201,707 | B1 | 4/2007 | Moon |
| 7,214,168 | B2 | 5/2007 | Rodgers, Jr. |
| 7,278,955 | B2 | 10/2007 | Giannelli et al. |
| 7,292,151 | B2 | 11/2007 | Ferguson |
| 7,303,508 | B2 | 12/2007 | Toyama et al. |
| 7,303,510 | B2 | 12/2007 | Gebhardt |
| 7,319,457 | B2 | 1/2008 | Lin et al. |
| 7,322,907 | B2 | 1/2008 | Bowser |

(56) References Cited

U.S. PATENT DOCUMENTS 7,341,542 B2 3/2008 Ohrt et al.
7,347,806 B2 3/2008 Nakano et al.
7,352,365 B2 4/2008 Trachte
7,364,533 B2 4/2008 Baker
7,369,121 B2 5/2008 Lane
7,374,522 B2 5/2008 Arnold
7,375,450 B2 5/2008 Tanaka et al.
7,393,308 B1 7/2008 Huang
7,402,145 B1 7/2008 Woggon
7,422,548 B1 9/2008 Teng
7,445,583 B2 * 11/2008 Chen ..... A63B 71/0622 248/123.11
7,462,134 B2 12/2008 Lull et al.
7,491,154 B2 2/2009 Yonehana et al.
7,530,932 B2 5/2009 Lofgren et al.
7,549,947 B2 6/2009 Hickman et al.
7,572,205 B1 8/2009 Cribar
7,575,537 B2 8/2009 Ellis
7,585,258 B2 9/2009 Watson et al.
7,594,878 B1 9/2009 Joannou
7,648,446 B2 1/2010 Chiles et al.
7,682,286 B2 3/2010 Badarneh et al.
7,682,287 B1 3/2010 Hsieh
7,704,192 B2 4/2010 Dyer et al.
7,749,137 B2 7/2010 Watt et al.
7,771,325 B2 8/2010 Baker
7,803,096 B2 9/2010 Mehta
7,837,595 B2 11/2010 Rice
7,841,964 B2 11/2010 Radow
7,862,476 B2 1/2011 Radow
7,867,146 B2 1/2011 Ge et al.
7,871,355 B2 1/2011 Yeh
7,874,615 B2 1/2011 Huyck
7,887,465 B2 2/2011 Uffelman
7,963,889 B2 6/2011 Badarneh et al.
7,967,709 B2 6/2011 Emura
8,001,472 B2 8/2011 Gilley et al.
8,002,684 B2 8/2011 Laurent
8,012,067 B2 9/2011 Joannou
8,029,415 B2 10/2011 Ashby et al.
8,047,965 B2 11/2011 Shea
8,062,190 B2 11/2011 Pyles et al.
8,105,213 B2 1/2012 Stewart et al.
8,109,858 B2 2/2012 Redmann
8,123,527 B2 2/2012 Holljes
8,200,323 B2 6/2012 Dibenedetto et al.
8,221,290 B2 7/2012 Vincent et al.
8,260,858 B2 9/2012 Belz et al.
8,306,635 B2 11/2012 Pryor
8,360,904 B2 1/2013 Oleson et al.
8,485,945 B2 7/2013 Leonhard
8,585,561 B2 11/2013 Watt et al.
8,702,430 B2 4/2014 Dibenedetto et al.
8,734,157 B1 5/2014 Hummel, III
8,827,871 B2 9/2014 Golesh
8,876,669 B2 11/2014 Vujicic
9,011,291 B2 4/2015 Birrell
9,039,581 B2 5/2015 Chia et al.
9,044,635 B2 6/2015 Lull
9,088,450 B2 7/2015 Jung et al.
9,114,276 B2 8/2015 Bayerlein et al.
9,162,106 B1 10/2015 Scheiman
9,174,085 B2 11/2015 Foley
9,275,504 B1 3/2016 Cooper
9,278,249 B2 3/2016 Watterson
9,358,418 B2 6/2016 Golesh
9,358,422 B2 6/2016 Brontman
9,367,668 B2 6/2016 Flynt et al.
9,389,718 B1 7/2016 Letourneur
9,452,320 B2 9/2016 Yang
9,468,794 B2 10/2016 Barton
9,517,812 B2 12/2016 Tetsuka
9,566,469 B1 2/2017 Rector
9,579,534 B2 2/2017 Sutkowski et al.
9,623,286 B1 4/2017 Chen
9,707,443 B2 7/2017 Warren
9,750,343 B2 9/2017 McBride et al.
9,757,611 B1 9/2017 Colburn
9,782,625 B1 10/2017 Blum et al.
9,827,458 B2 11/2017 Dalton
9,845,133 B2 12/2017 Craven et al.
9,886,458 B2 2/2018 Jung et al.
9,950,209 B2 4/2018 Yim et al.
9,981,153 B2 5/2018 Chou
9,987,513 B2 6/2018 Yim et al.
9,999,818 B2 6/2018 Hawkins, III et al.
10,004,940 B2 6/2018 Badarneh
2001/0001303 A1 5/2001 Ohsuga et al.
2002/0024521 A1 2/2002 Goden
2002/0045519 A1 4/2002 Watterson
2002/0055419 A1 5/2002 Hinnebusch
2002/0055422 A1 5/2002 Airmet
2002/0107058 A1 8/2002 Namba et al.
2002/0142890 A1 10/2002 Ohrt
2003/0073545 A1 4/2003 Liu
2003/0078138 A1 4/2003 Toyama
2003/0148853 A1 8/2003 Alessandri
2003/0171190 A1 9/2003 Rice
2004/0023761 A1 2/2004 Emery
2004/0063549 A1 4/2004 Kuo
2004/0067833 A1 4/2004 Talish
2004/0072657 A1 4/2004 Arguilez
2004/0097331 A1 5/2004 Zillig
2004/0180719 A1 9/2004 Feldman
2004/0224740 A1 11/2004 Ball et al.
2004/0248711 A1 12/2004 Rodgers
2005/0025615 A1 2/2005 Gabrys et al.
2005/0049117 A1 3/2005 Rodgers
2005/0064994 A1 3/2005 Matsumoto
2005/0085353 A1 4/2005 Johnson
2005/0113158 A1 5/2005 Sterchi et al.
2005/0143226 A1 6/2005 Heidecke
2005/0209061 A1 9/2005 Crawford et al.
2005/0245370 A1 11/2005 Boland
2005/0264112 A1 12/2005 Tanaka et al.
2006/0003872 A1 1/2006 Chiles et al.
2006/0035758 A1 2/2006 Rogozinski
2006/0063644 A1 3/2006 Yang
2006/0122035 A1 6/2006 Felix
2006/0128533 A1 6/2006 Ma
2006/0193679 A1 * 8/2006 Lin ..... F16B 7/1427 403/109.5
2006/0194679 A1 8/2006 Hatcher
2006/0229163 A1 10/2006 Waters
2006/0240947 A1 10/2006 Qu
2006/0264286 A1 11/2006 Hodjat
2006/0287089 A1 12/2006 Addington et al.
2006/0287161 A1 12/2006 Dalebout
2006/0293154 A1 12/2006 Graber
2007/0037667 A1 2/2007 Gordon
2007/0038137 A1 2/2007 Arand et al.
2007/0042868 A1 2/2007 Fisher
2007/0049467 A1 3/2007 Lin
2007/0079691 A1 4/2007 Turner
2007/0111858 A1 5/2007 Dugan
2007/0123390 A1 5/2007 Mathis
2007/0142183 A1 6/2007 Chang
2007/0149363 A1 6/2007 Wang
2007/0161467 A1 7/2007 Lee
2007/0179023 A1 8/2007 Dyer
2007/0190508 A1 8/2007 Dalton
2007/0197274 A1 8/2007 Dugan
2007/0197345 A1 8/2007 Wallace et al.
2007/0225119 A1 9/2007 Schenk
2007/0238584 A1 10/2007 Lee
2007/0270726 A1 11/2007 Chou
2007/0281828 A1 12/2007 Rice
2007/0298935 A1 12/2007 Badarneh
2007/0298937 A1 12/2007 Shah
2008/0020902 A1 1/2008 Arnold
2008/0020907 A1 1/2008 Lin
2008/0026838 A1 1/2008 Dunstan et al.
2008/0032864 A1 2/2008 Hakki
2008/0032871 A1 2/2008 Yeh

(56) References Cited

U.S. PATENT DOCUMENTS

2008/0076637 A1 3/2008 Gilley et al.
2008/0077619 A1 3/2008 Gilley et al.
2008/0086318 A1 4/2008 Gilley et al.
2008/0103024 A1 5/2008 Habing
2008/0108917 A1 5/2008 Joutras et al.
2008/0119333 A1 5/2008 Bowser
2008/0139370 A1 6/2008 Charnitski
2008/0155077 A1 6/2008 James
2008/0207407 A1 8/2008 Yeh
2008/0214971 A1 9/2008 Talish
2008/0242511 A1 10/2008 Munoz et al.
2008/0279896 A1 11/2008 Heinen et al.
2008/0293488 A1 11/2008 Cheng et al.
2009/0042696 A1 2/2009 Wang
2009/0048493 A1 2/2009 James et al.
2009/0053682 A1 2/2009 Stern
2009/0118098 A1 5/2009 Yeh
2009/0128516 A1 5/2009 Rimon et al.
2009/0137367 A1 5/2009 Hendrickson et al.
2009/0176625 A1 7/2009 Giannelli et al.
2009/0197740 A1 8/2009 Julskjaer et al.
2009/0221405 A1 9/2009 Wang
2009/0221407 A1 9/2009 Hauk
2009/0269728 A1 10/2009 Verstegen et al.
2009/0298649 A1 12/2009 Dyer et al.
2010/0035726 A1 2/2010 Fisher et al.
2010/0064255 A1 3/2010 Rottler et al.
2010/0077564 A1 4/2010 Saier et al.
2010/0081548 A1 4/2010 Labedz
2010/0087298 A1 4/2010 Zaccherini
2010/0156625 A1 6/2010 Ruha
2010/0184568 A1 7/2010 Schippers
2010/0210418 A1 8/2010 Park
2010/0240458 A1 9/2010 Gaiba et al.
2010/0289772 A1 11/2010 Miller
2010/0292600 A1 11/2010 Dibenedetto et al.
2010/0304932 A1 12/2010 Kolman et al.
2010/0311552 A1 12/2010 Sumners
2011/0017168 A1 1/2011 Gilpatrick
2011/0131005 A1 6/2011 Ueshima et al.
2011/0143769 A1 6/2011 Jones et al.
2011/0172059 A1 7/2011 Watterson et al.
2011/0275482 A1 11/2011 Brodess et al.
2011/0283188 A1 11/2011 Farrenkopf et al.
2011/0283231 A1 11/2011 Richstein et al.
2011/0319229 A1 12/2011 Corbalis et al.
2012/0015778 A1 1/2012 Lee et al.
2012/0015779 A1 1/2012 Powch et al.
2012/0071301 A1 3/2012 Kaylor et al.
2012/0088634 A1 4/2012 Heidecke
2012/0088640 A1 4/2012 Wissink
2012/0178592 A1 7/2012 Chieh
2012/0212505 A1 8/2012 Burroughs et al.
2012/0253489 A1 10/2012 Dugan
2012/0258433 A1 10/2012 Hope et al.
2012/0277891 A1 11/2012 Aragones et al.
2012/0296455 A1 11/2012 Ohnemus et al.
2012/0322625 A1 12/2012 Park
2013/0035612 A1 2/2013 Mason et al.
2013/0061714 A1 3/2013 Hsiung
2013/0072356 A1* 3/2013 Machida ..... A63B 21/00076 482/58
2013/0095978 A1 4/2013 Sauter
2013/0228063 A1 9/2013 Turner
2013/0237383 A1 9/2013 Chen
2013/0328285 A1* 12/2013 Frohlicher ..... B62J 1/08 280/287
2013/0346043 A1 12/2013 Mewes et al.
2014/0039840 A1 2/2014 Yuen et al.
2014/0052280 A1 2/2014 Yuen et al.
2014/0077494 A1 3/2014 Sutkowski
2014/0085077 A1 3/2014 Luna et al.
2014/0087923 A1 3/2014 Warren
2014/0100464 A1 4/2014 Kaleal et al.
2014/0123325 A1 5/2014 Jung et al.
2014/0139450 A1 5/2014 Levesque et al.
2014/0221168 A1 8/2014 Chen
2014/0265690 A1 9/2014 Henderson
2014/0274564 A1 9/2014 Greenbaum
2014/0274581 A1 9/2014 Yang
2015/0004579 A1 1/2015 Shelton
2015/0065308 A1* 3/2015 Golesh ..... A63B 21/015 482/57
2015/0177083 A1 6/2015 Redmond
2015/0182781 A1 7/2015 Watterson
2015/0209617 A1 7/2015 Hsiao
2015/0346994 A1 12/2015 Chanyontpatanakul
2015/0352402 A1 12/2015 Arnold et al.
2016/0263426 A1 9/2016 Mueller et al.
2016/0346595 A1 12/2016 Dalebout et al.
2017/0036053 A1 2/2017 Smith et al.
2017/0259111 A1 9/2017 Hsieh
2017/0312580 A1 11/2017 Chang
2017/0319906 A1 11/2017 Chang et al.
2018/0117383 A1 5/2018 Workman
2018/0117393 A1 5/2018 Ercanbrack
2019/0178313 A1 6/2019 Wrobel

FOREIGN PATENT DOCUMENTS

KR 20140101328 A * 8/2014
TW 407113 10/2000
TW M245969 10/2004
TW I264321 10/2006
TW M442167 12/2012
TW I579197 4/2017

OTHER PUBLICATIONS

KR-20140101328-A (Chamber pot of bicycle for health and standingtype) Published Aug. 2014.*
The Engineering Toolbox, Pipe-Nominal Wall Thickness [online], Nov. 19, 2016, [retrieved on Dec. 2, 2019]. Retrieved from the Internet <URL: https://web.archive.org/web/20161119163515/https://www.engineeringtoolbox.com/nominal-wall-thickness-pipe-d_1337.html>. (Year: 2016).*
Written Opinion and International Search Report Issued in application No. PCT/US2018/013626 dated May 10, 2018.
English Translation of Office Action and Search Report issued in Taiwan Patent Application No. 107143798 dated Aug. 22, 2019.
Webpage: https://www.proform.com/exercise-bikes/tour-de-france-pro-5-bike updated Aug. 22, 2016.
English translation of Search Report and Office Action issued in Taiwan Patent Application No. 106133333 dated Apr. 19, 2018.
International Search Report and Written Opinion issued in application PCT/US2017/057405 dated Jan. 19, 2018.

* cited by examiner

EXERCISE CYCLE

CROSS REFERENCE TO RELATED APPLICATIONS

This application claims priority to U.S. Provisional Patent Application No. 62/446,425, filed on Jan. 14, 2017, which application is incorporated herein by reference in its entirety.

TECHNICAL FIELD

The present disclosure relates generally to systems and methods for exercising. More particularly, the present disclosure relates to systems and methods for selective adjustment and use of an exercise cycle.

BACKGROUND

Exercise devices have long been a mainstay of the home and institutional exercise equipment market. One advantage of exercise devices is that they can be used when inclement weather prevents outdoor exercise. A stationary exercise cycle is a common example of such exercise devices. With a typical stationary exercise cycle, a user sits on a seat, holds onto a set of handles or a handle bar, and pedals with his or her feet.

In order to provide variety during an exercise routine, the user can increase or decrease his or her pedaling rate at various times during the exercise routine. This can be done by increasing or decreasing the amount of effort the user uses to pedal or by increasing or decreasing the pedaling resistance provided by the exercise cycle. Additionally, many stationary exercise cycles are pre-programmed with one or more exercise routines that automatically adjust the pedaling resistance at various time intervals during the exercise routine. Adjusting the pedaling rate and/or the pedaling resistance can allow a user to achieve a workout suitable for the user's fitness level and goals. More recently, some exercise cycles have been equipped with tilting capabilities that enable the exercise cycle to tilt forward, backward, or side-to-side. Such titling can more closely simulate the experience of riding a bicycle in the outdoors by replicating the feel of riding up and down hills and around corners.

Many exercise cycles include a console to allow a user to view exercise program information and input or select different exercise programs and/or features. Such consoles typically allow a user some degree of interactivity and tailoring of device features, such as speed, incline, and resistance. In some cases, the consoles can also provide entertainment (e.g., television, video, internet) to a user during use of the exercise cycle.

To accommodate users of different sizes and having different preferences, many exercise cycles are adjustable. For instance, the seat or handles/handle bar can be adjusted up and down or forward and backward. However, many of the mechanisms used to adjust the exercise cycle are complicated, difficult, and time-consuming to manipulate.

Examples of various adjustable exercise cycles are described in U.S. Pat. Nos. 9,358,418, 9,044,635, 8,827,871, 7,771,325, and 7,364,533.

SUMMARY OF THE DISCLOSURE

According to one example embodiment, an exercise cycle includes a frame configured to rest upon a support surface. At least one of a handle bar assembly or a seat is connected to the frame. In the case of a handle bar assembly, the handle bar assembly is configured to be held during use of the exercise cycle. In the case of a seat, the seat is configured to support a user during use of the exercise cycle. An adjustment mechanism for selectively adjusting the position of the handle bar assembly or the seat relative to the frame is also included. The adjustment mechanism includes a guide frame fixedly secured to the frame and a sliding frame slidably mounted on the guide frame. The handle bar assembly or the seat is mounted on the sliding frame. The adjustment mechanism also includes one or more cams pivotally disposed between the guide frame and the sliding frame. The one or more cams are rotatable between an unlocked position and a locked position. The one or more cams restrict movement of the sliding frame when the one or more cams are in the locked position and allow the sliding frame to move relative to the guide frame when the one or more cams are in the unlocked position.

According to another example embodiment, an exercise cycle includes a frame configured to rest upon a support surface, a console mounted to the frame, and a pivot assembly pivotally connecting the console to the frame. The console includes a display. The pivot assembly enables the console to rotate at least 90° about a generally vertical axis.

In another example embodiment, a method of performing an exercise routine includes riding on an exercise cycle, rotating a console of the exercise cycle at least 90° in a first direction about a generally vertical axis, and performing one or more exercises while viewing exercise instructions on the rotated console of the exercise device.

An exercise cycle according to another example embodiment includes a support base configured to rest upon a support surface and an upright support structure. The upright support structure includes a first support member pivotally connected to the support base and a second support member connected to the first support member. A handle bar assembly is mounted on the second support member. An incline mechanism is configured to selectively vary a pitch of the upright support structure relative to the support base. The incline mechanism is connected between the support base and the first support member and is aligned with or extends generally parallel to the second support member.

DETAILED DESCRIPTION

Figure 1:
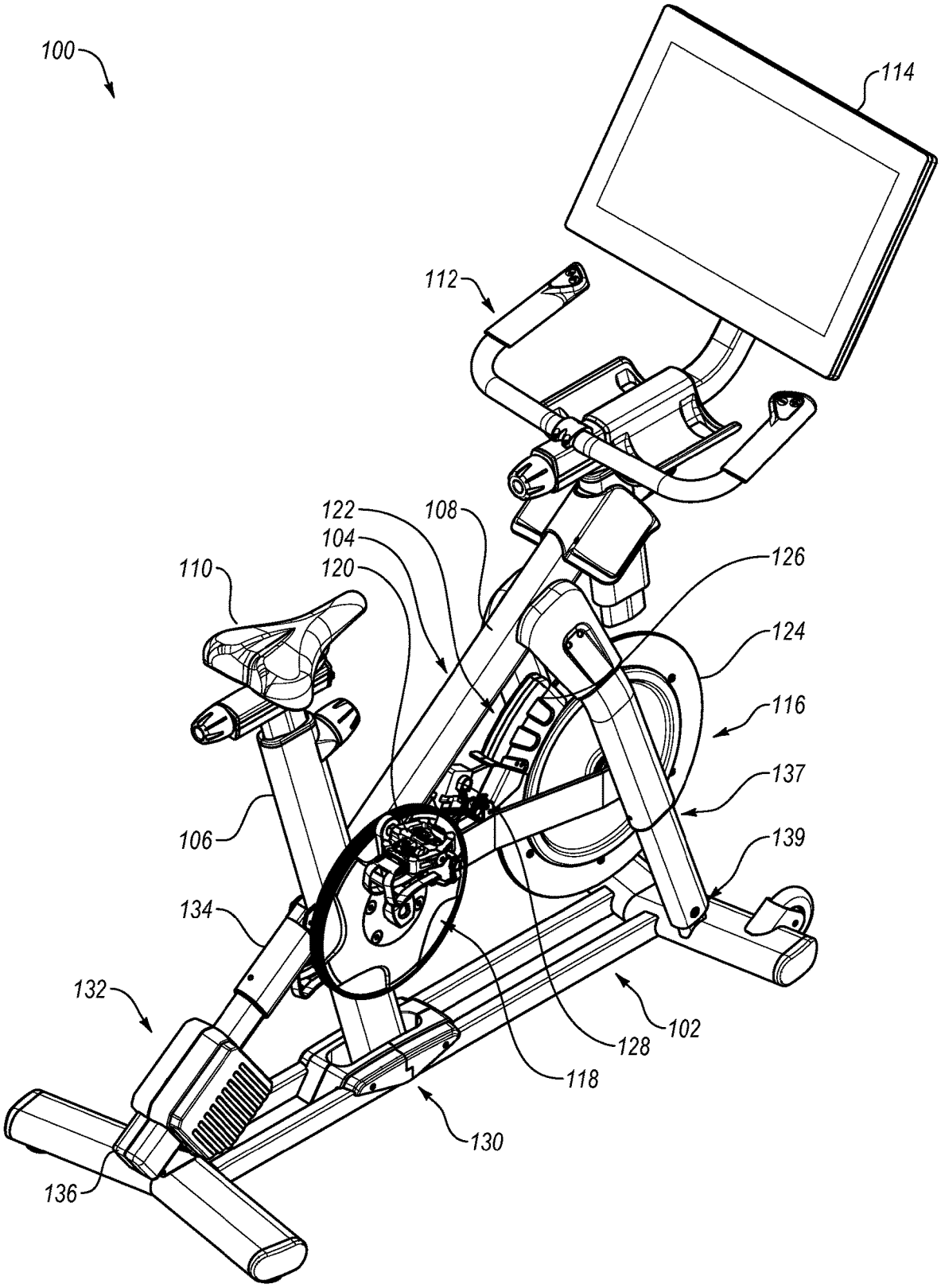
FIG. 1 is an exemplary exercise cycle according to the present disclosure.

In FIG. 1, an example stationary exercise cycle 100 is illustrated. Exercise cycle 100 includes a support base 102 and a generally upright support structure 104 pivotally coupled thereto. In the illustrated embodiment, upright support structure 104 includes two support members 106, 108, and may be referred to as a bicycle frame, although it need not look like, or act like, a bicycle frame of a road or mountain bicycle used in real-world cycling. Support member 106 of the illustrated embodiment includes a seat 110 upon which a user may sit when exercising on exercise cycle 100. Support member 108 includes a handle bar assembly 112 and a control panel or console 114.

In the illustrative embodiment, a drive assembly 116 is mounted on upright support structure 104. Drive assembly 116 includes a rotatable pedal assembly 118 having a pair of pedals 120, which a user can engage with his or her feet to rotate pedal assembly 118. Drive assembly 116 also includes, in this embodiment, a resistance assembly 122, which can affect the force required from the user to rotate pedal assembly 118. Resistance assembly 122 includes a flywheel 124, a resistance mechanism 126, and a motor 128. Resistance mechanism 126 and motor 128 are optionally each adapted to selectively adjust the force required to rotate pedal assembly 118. Thus, when a constant force is applied at pedal assembly 118, resistance mechanism 126 and/or motor 128 may vary the rotational speed of flywheel 124. In the illustrated embodiment, resistance mechanism 126 comprises a magnetic brake for controlling resistance to rotation of pedal assembly 118 and/or the rotational speed of flywheel 124.

Resistance assembly 122 is coupled to pedal assembly 118 such that the resistance provided to flywheel 124 by resistance mechanism 126 and/or motor 128 affects the resistance to the rotation of pedal assembly 1118. In other words, when a resistance is applied to flywheel 124, a braking force is present and it is generally more difficult for a user to rotate pedal assembly 118. Conversely, when little or no resistance is applied to flywheel 124, it is relatively easy for a user to rotate pedal assembly 118. By adjusting the amount of resistance applied to flywheel 124, exercise cycle 100 can thus vary the speed at which a user can pedal and/or the resistance experienced by the user as he or she pedals on exercise cycle 100. In this manner exercise cycle 100 is able to simulate the types of resistances, coasting, and pedaling speeds that a user may experience if riding a bicycle outdoors.

Figure 2:
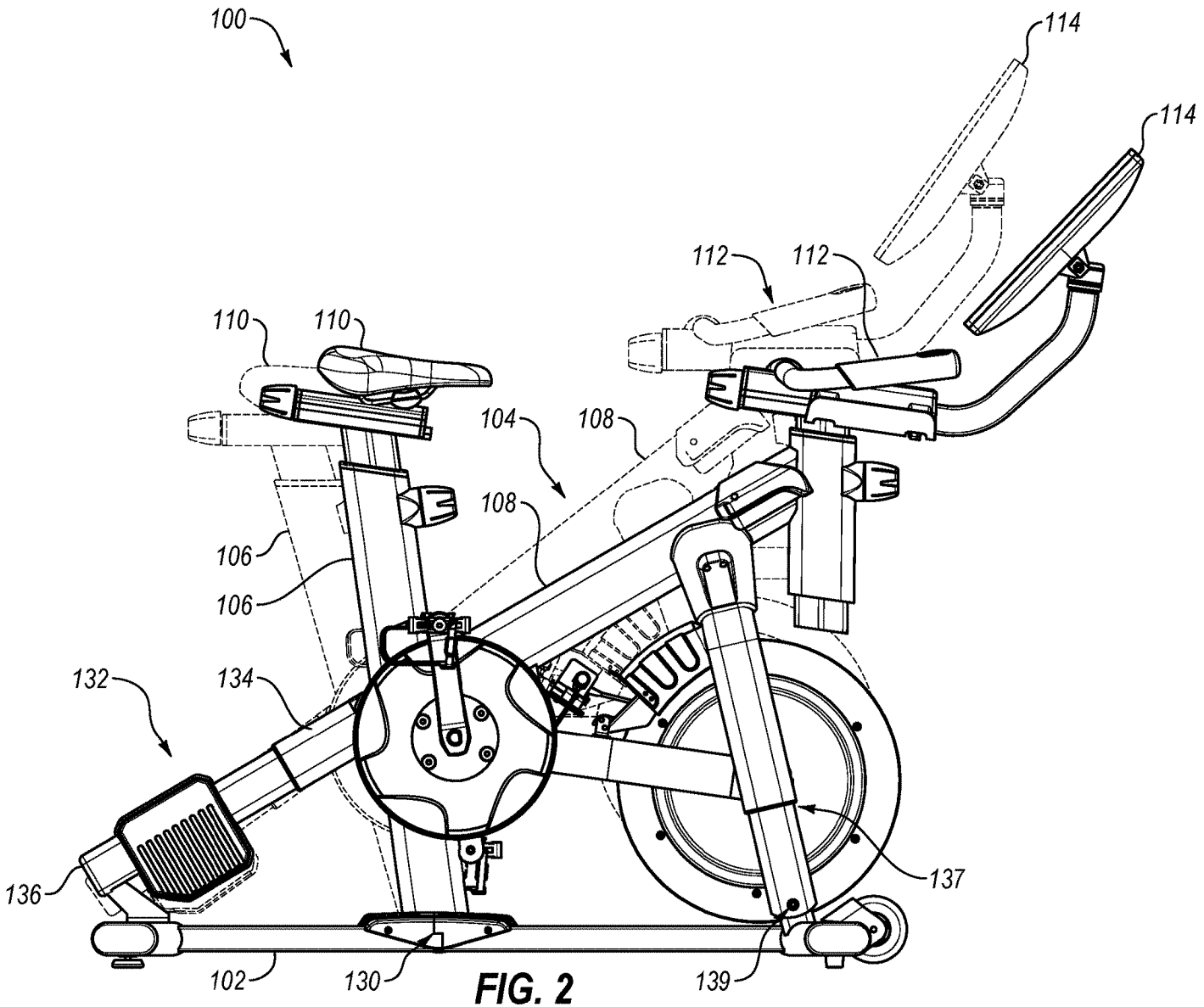
FIG. 2 is a side illustration of the exercise cycle of FIG. 1 with an upright frame shown in a forward tilted position, and a neutral position featured in phantom view.

In addition to the ability to control and vary the speed and resistance of pedal assembly 118 and/or flywheel 124, exercise cycle 100 also permits varying the vertical pitch of the exercise cycle 100 by selectively tilting upright support structure 104 relative to the floor or other surface upon which exercise cycle 100 rests. As depicted in FIG. 2 in phantom lines, upright support structure 104 can be oriented in a neutral position. In the neutral position, the illustrated exercise cycle 100 may include handle bar assembly 112 and seat 110 at generally the same vertical distance from the floor or other support surface, although such is illustrative only, and the handle bar assembly 112 and seat 110 may be at different heights, even in the neutral position.

In this embodiment, when upright support structure 104 is in the neutral position, a user sitting on seat 110 may feel that he or she is sitting on a bicycle that is on a generally level surface. Additionally, as illustrated in solid lines in FIG. 2, upright support structure 104 can be oriented in a forwardly tilted position such that handle bar assembly 112 is vertically closer to the floor or other support surface relative to seat 110, and relative to the position of handle bar assembly 112 in the neutral position. This is achieved by adjusting the vertical pitch of upright support structure 104 relative to a floor or other support surface. Tilting upright support structure 104 forward as illustrated in FIG. 2 enables a user to simulate riding down a hill.

Figure 3:
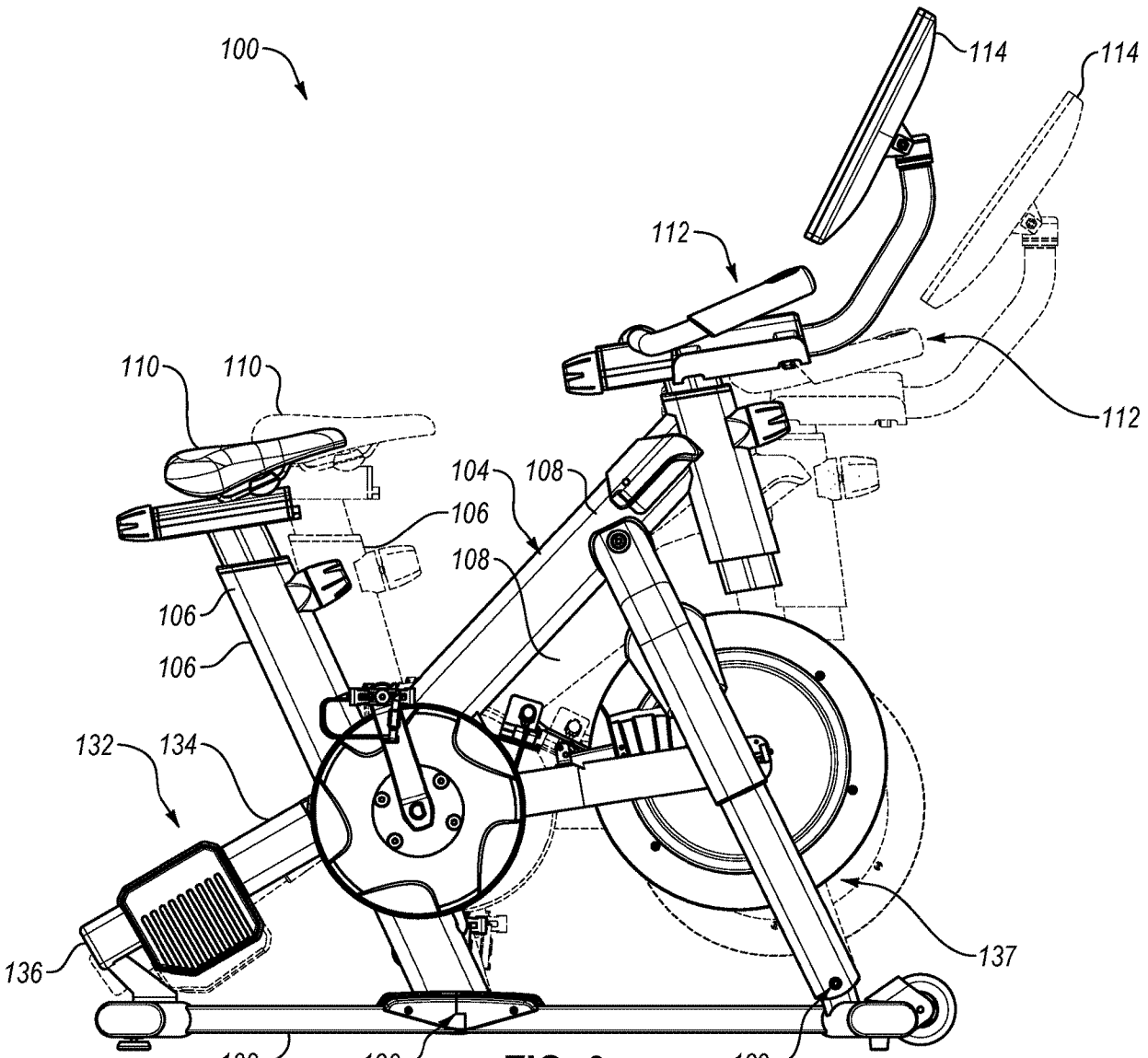
FIG. 3 is another side illustration of the exercise cycle of FIG. 1 with the upright frame shown in a backward tilted position, and a neutral position featured in phantom view.

In one embodiment, such as that illustrated in FIG. 3, upright support structure 104 can also be oriented in a backwardly tilted position in which handle bar assembly 112 is vertically further from the floor or other support surface when compared to seat 110 or when compared to the position of handle bar assembly 112 in the neutral position. Typical bicycle rides outside involve inclines and declines as well as flat surfaces, each of which can be accommodated and replicated by the tilting ability of upright support structure 104. Thus, exercise cycle 100 is able to more closely simulate a typical outdoor bicycle ride.

The forward and backward tilting of upright support structure 104 to adjust the vertical pitch of support structure 104 can be accomplished through pivotally coupling upright support structure 104 to support base 102 as depicted in FIGS. 1-3. As seen in FIGS. 1-3, upright support structure 104 is connected to support base 102 by pivot 130. Pivot 130 allows upright support structure 104 to tilt forward and backward as described herein. Pivot 130 can include a pin that extends through a portion of support base 102 and through upright support structure 104.

While pivot 130 allows upright support structure 104 to tilt forward and backward, incline mechanism 132, or another linearly or otherwise extending assembly, controls the vertical pitch of upright support structure 104. In the illustrative embodiment, incline mechanism 132 is coupled between support base 102 and support member 106. More particularly, a first end 134 of incline mechanism 132 pivotally couples to support member 106 while a second end 136 of incline mechanism 132 pivotally couples to a rear portion of support base 102. In the illustrated embodiment, incline mechanism 132 is aligned with and/or generally parallel to support member 108. As a result, incline mechanism 132 extends and contracts in a direction that is generally in line with or parallel to an axis of support member 108.

The extension and contraction of incline mechanism 132 raises or lowers support member 106 relative to support base 102, thereby determining the vertical pitch and tilt of upright support structure 104 relative to the floor or other support surface. For instance, in one embodiment, upon contraction of incline mechanism 132, support member 106 is lowered, causing upright support structure 104 to tilt backward so that seat 110 is at a distance relative to the floor or other support surface that is below the position of seat 10 when at the neutral position. When incline mechanism 132 is selectively extended to an extended position, support member 106 is raised, causing upright support structure 104 to tilt forward so that seat 110 is vertically higher relative to seat 110 when at the neutral position. Through the forward and backward tilting of upright support structure 104, as described above, exercise cycle 100 is able to more closely simulate for a user the experience of riding a bicycle on level ground as well as up and down hills.

In the illustrated embodiment, the support base 102, the upright support structure 104, the pivot 130, and the incline mechanism 132 have unique spatial arrangements relative to one another. Some of the spatial arrangements provide improved performance or functionality to the exercise cycle 100. For instance, pivot 130 is disposed directly or substantially below the center of gravity of the upright support structure 104 and/or a user riding on exercise cycle 100. Such placement of pivot 130 can reduce or minimize the load supported by incline mechanism 132 and the force required of incline mechanism 132 to tilt upright support structure 104 as described herein.

In the illustrated embodiment, incline mechanism 132 is connect to support base 102 such that incline mechanism 132 and support base 102 form an angle of about 35° when upright support structure 104 is in the neutral position described above. In some embodiments, when upright support structure 104 is in the neutral position, incline mechanism 132 and support base 102 form an angle of between about 10° and about 80°, between about 20° and about 70°, between about 25° and about 45°, between about 25° and about 60°, or any angle within the foregoing ranges.

Similarly, in the illustrated embodiment, support member 106 of upright support structure 104 is connect to support base 102 such that support member 106 and support base 102 form an angle of about 75° when upright support structure 104 is in the neutral position described above. In some embodiments, when upright support structure 104 is in the neutral position, support member 106 and support base 102 form an angle of between about 25° and about 90°, between about 35° and about 85°, between about 45° and about 80°, between about 60° and about 80°, or any angle within the foregoing ranges.

Likewise, in the illustrated embodiment, support member 106 of upright support structure 104 is connect to incline mechanism 132 such that support member 106 and incline mechanism 132 form an angle of about 70° when upright support structure 104 is in the neutral position described above. In some embodiments, when upright support structure 104 is in the neutral position, support member 106 and incline mechanism 132 form an angle of between about 25° and about 90°, between about 35° and about 85°, between about 45° and about 80°, between about 60° and about 80°, or any angle within the foregoing ranges.

As shown in FIGS. 1-3, exercise cycle 100 can also include a telescoping frame assembly 137. Telescoping frame assembly 137 is connected between upright support structure 104 and support base 102. More specifically, telescoping frame assembly 137 is connected between support member 108 and a forward end of support base 102. As upright support structure 104 tilts forward or backward, telescoping frame assembly 137 contracts or extends. Additionally, telescoping frame assembly 137 can also pivot relative to support base 102 when upright support structure 104 tilts forward or backward. To accommodate the pivoting of telescoping frame assembly 137, telescoping frame assembly 137 can be connected to support base 102 by a pivot connection 139. In some embodiments, telescoping frame assembly 137 provides load-bearing support to upright support structure 104.

As noted above in connection with FIG. 1, exercise cycle 100 includes a console 114. Console 114 can include a controller that controls one or more operational aspects of exercise cycle 100. For instance, the controller can control resistance mechanism 126 and/or motor 128 to increase or decrease the resistance to the rotation of pedal assembly 118. Likewise, the controller can control incline mechanism 132 to increase or decrease the forward and backward tilting of upright support structure 104.

Console 114 also includes one or more interface devices. Such interface devices may be either input devices or output devices. Input devices (e.g., buttons, sliders, touchscreens, etc.) enable a user to input and vary the operating parameters (resistance, speed, incline, time, distance, program selection, heart rate controls, etc.) of the exercise cycle 100. The output devices (e.g., lights, speakers, digital displays, video displays, etc.) can provide the user with information about the operation of exercise cycle 100, entertainment (e.g., music, radio, video, internet, etc.), and the like.

Figure 4:
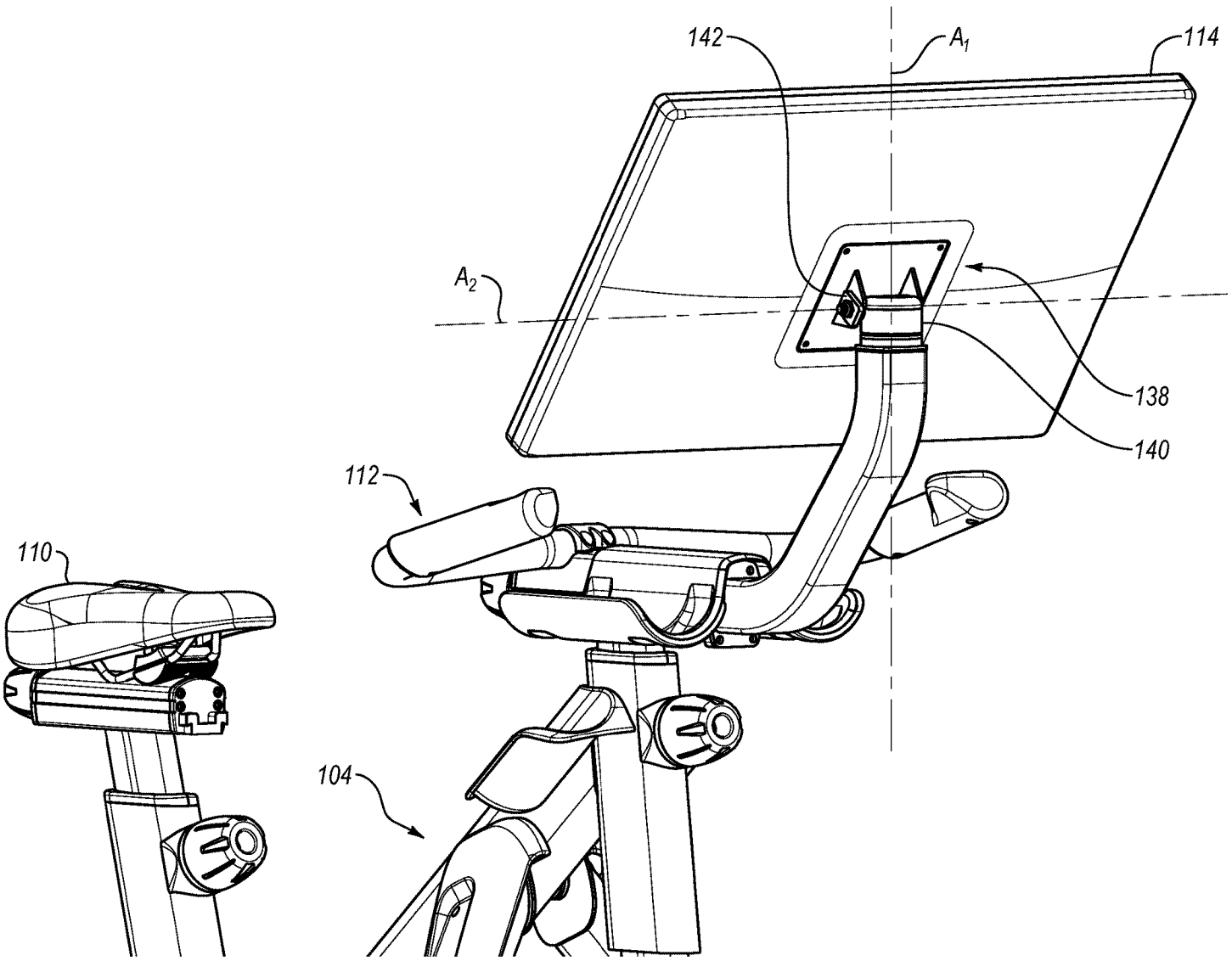
FIG. 4 is a perspective view of a portion of the exercise cycle of FIG. 1 showing a console pivot assembly.

Additionally, the output devices may provide instructions (e.g., video, text, audio, etc.) to a user regarding exercises that are performed separate from exercise cycle 100. For instance, as illustrated in FIG. 4, console 114 may be movably connected to upright support structure 104 so that console 114 can be rotated for viewing by a user that is not sitting on exercise cycle 100. The movable connection between console 114 and upright support structure 104 is provided by a pivot assembly 138. In the illustrated embodiment, pivot assembly 138 enables console 114 to pivot or rotate about two axes. In particular, pivot assembly 138 includes a horizontal pivot 140 that enables console 114 to pivot or rotate in a generally horizontal plane, such that console 114 pivots or rotates about a generally vertical axis $A_1$.

In the present embodiment, horizontal pivot 140 enables console 114 to pivot or rotate more than 90° in one direction. In particular, from a neutral position where console 114 faces seat 110, horizontal pivot 140 enables console 114 to pivot or rotate more than 90° about axis $A_1$ in one direction. In some embodiments, horizontal pivot 140 enables console 114 to rotate about axis $A_1$ more than 90° in two opposite directions from the neutral position. Thus, in some embodiments, console 114 can pivot or rotate about axis $A_1$ more than a total of 180°. In other embodiments, console 114 can pivot or rotate up to or more than 180° about axis $A_1$ in two opposite directions from a neutral position. In such embodiments, console 114 may be able to pivot or rotate up to or more than 360° about axis $A_1$.

In the illustrated embodiment, the pivot assembly 138 also includes a vertical pivot 142 that enables console 114 to pivot or rotate in a generally vertical plane, such that console 114 pivots or rotates about a generally horizontal axis $A_2$. In the present embodiment, vertical pivot 142 enables console 114 to pivot or rotate at least than 180° about axis $A_2$. In particular, from a neutral position where console 114 faces seat 110, vertical pivot 142 enables console 114 to pivot or rotate at least 180° about axis $A_2$ so that console 114 faces away from seat 110.

Figure 5:
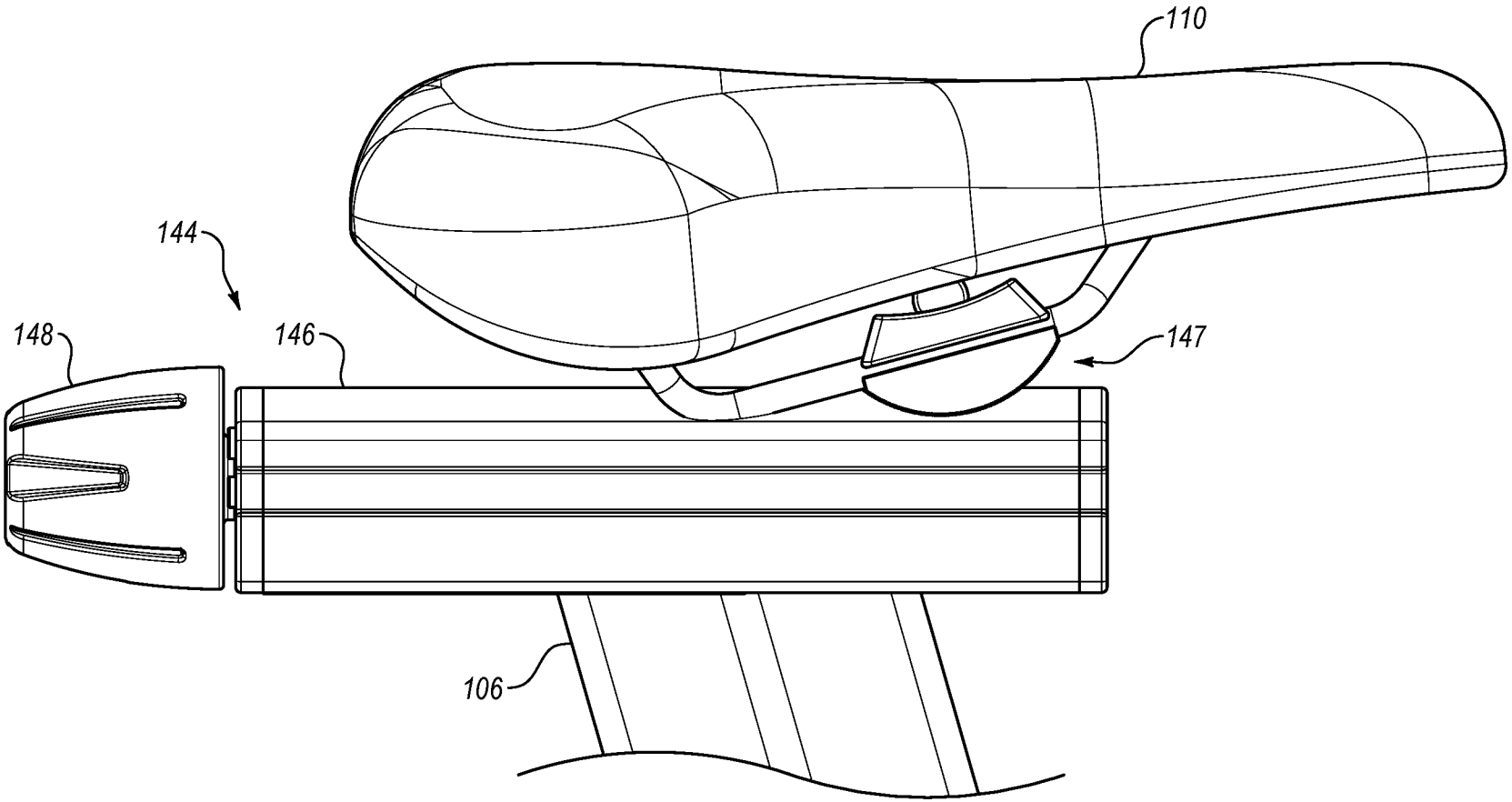
FIG. 5 is a side view of a seat adjustment mechanism.

Attention is now directed to FIGS. 5-7B, which illustrate a seat adjustment mechanism 144 that enables the position of seat 110 to be selectively adjusted forward and backward. As can be seen in FIG. 5, seat adjustment mechanism 144 includes a housing or frame 146 (as referred to herein as sliding frame 146) on which seat 110 is mounted. In some embodiments, such as that illustrated in FIG. 5, seat 110 can be adjustably mounted to housing or frame 146 by a tilting mechanism 147 to enable seat 110 to be selectively tilted forward or backward (e.g., to raise or lower the front or rear portions of seat 110) as desired by a user.

Seat adjustment mechanism 144 also includes an adjustment knob 148 which, as discussed below, can be used to engage or disengage a locking mechanism of seat adjustment mechanism 144 and/or adjust the position of sliding frame 146 and seat 110. As also discussed below, when the locking mechanism is engaged, sliding frame 146 and seat 110 are secured in place. In contrast, when the locking mechanism is disengaged, sliding frame 146 and seat 110 can be selectively moved forward or backward relative to upright support structure 104 or support member 106 thereof. The ability to adjust the forward or backward position of seat 110 enables a user to adjust exercise cycle 100 to accommodate the user's particular desires or needs (e.g., size).

Figure 6A:
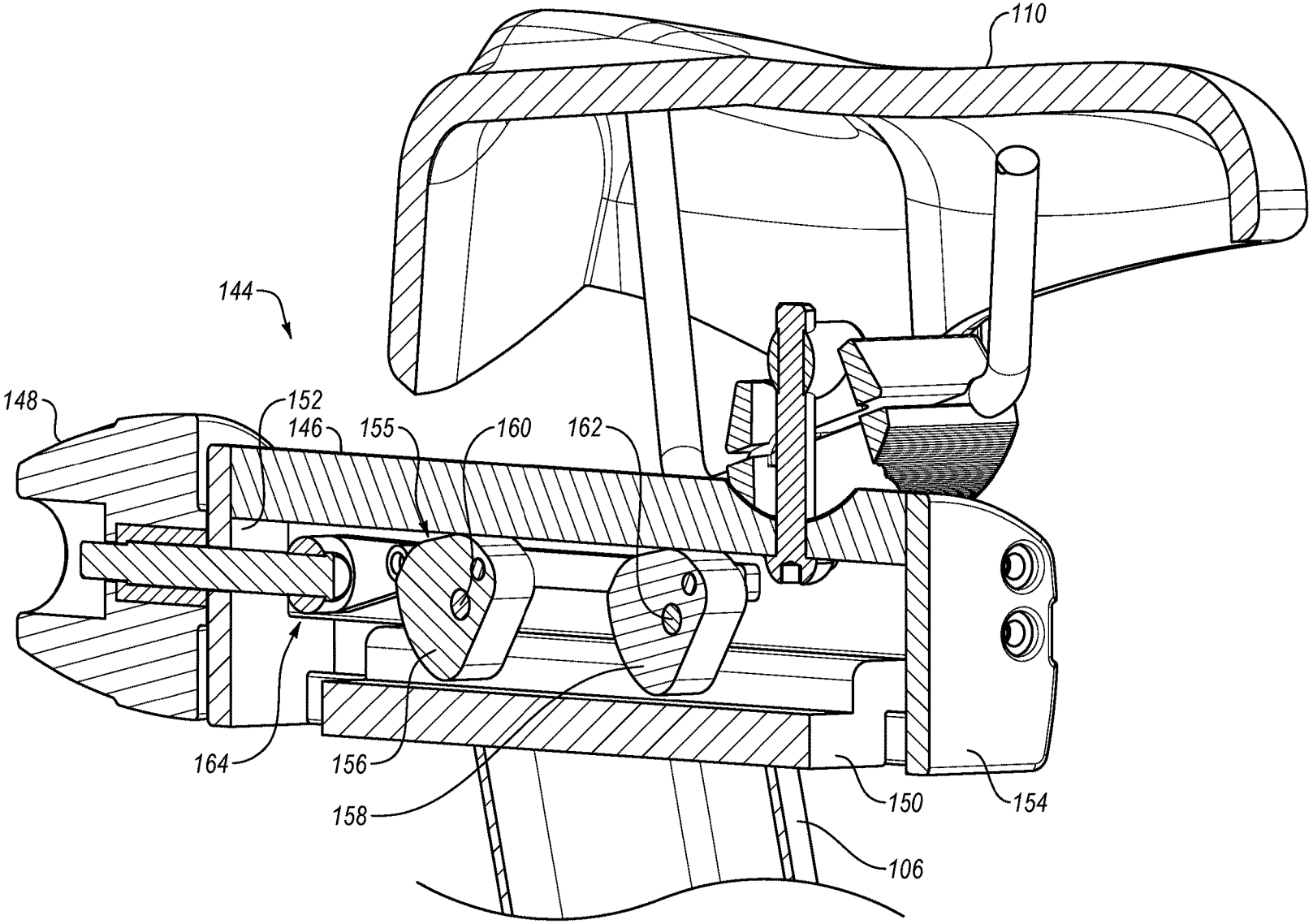
FIG. 6A is a side cross-sectional view of the seat adjustment mechanism of FIG. 5 in an unlocked configuration.
Figure 6B:
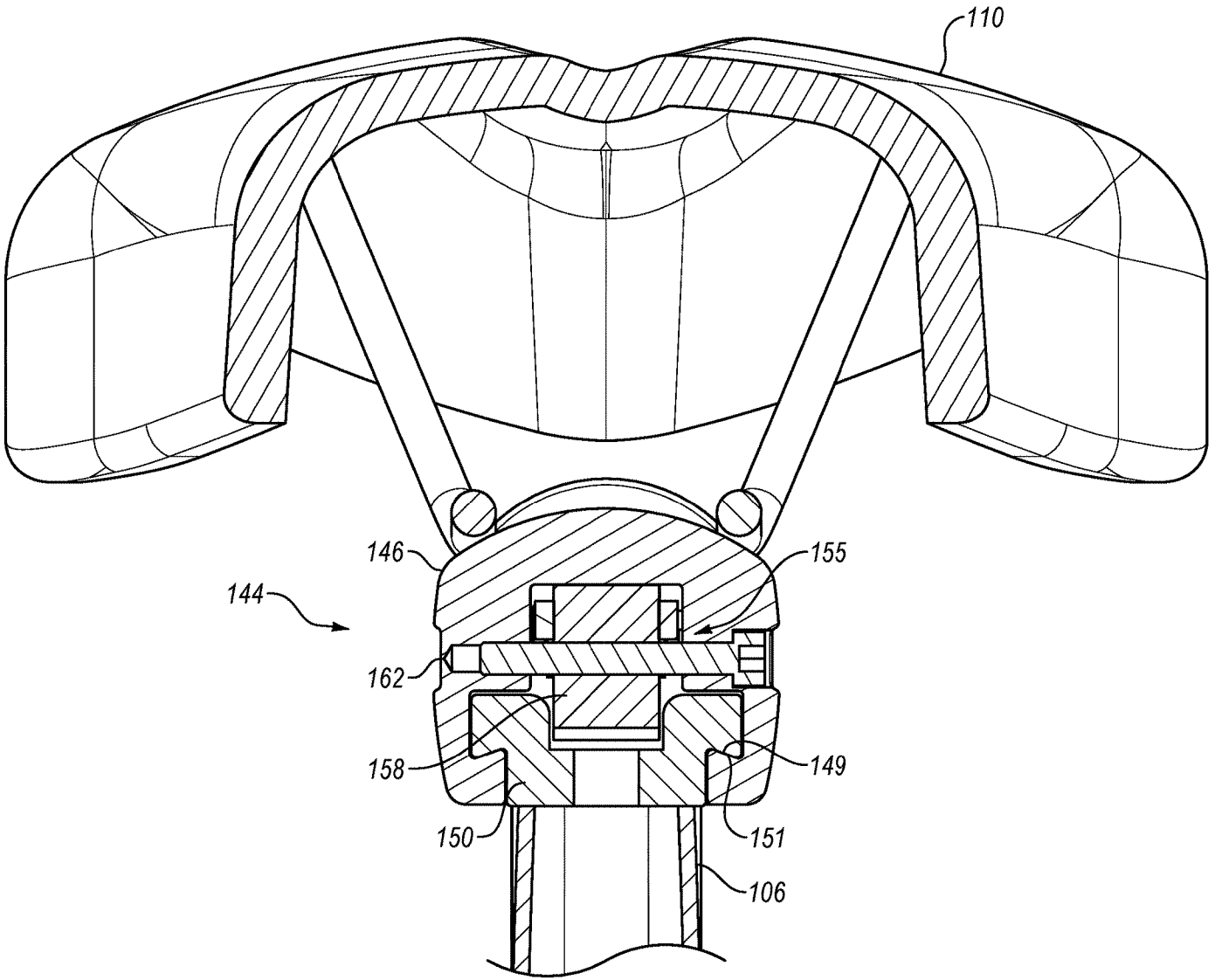
FIG. 6B is an end cross-sectional view of the seat adjustment mechanism of FIG. 5 in the unlocked configuration.
Figure 7A:
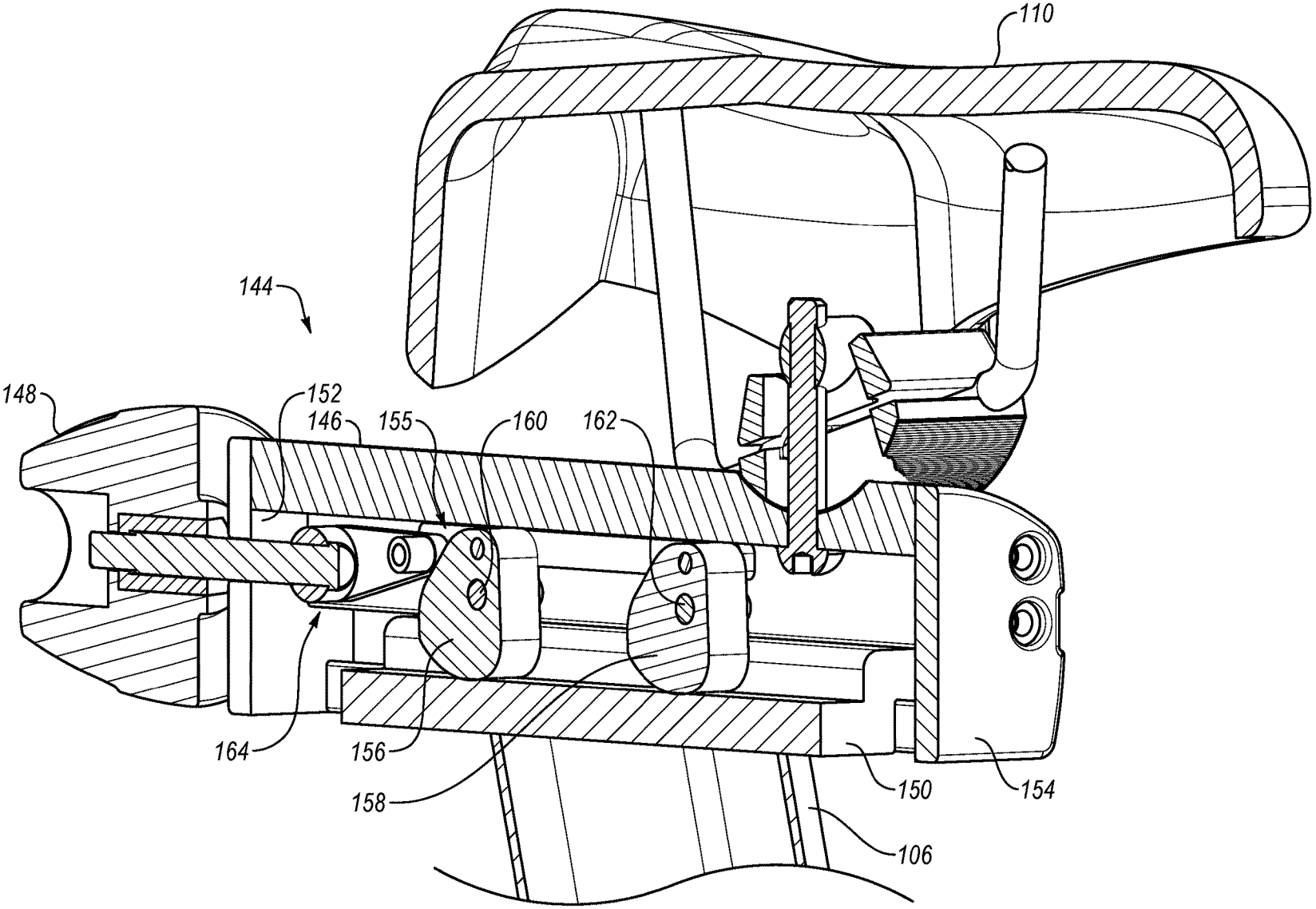
FIG. 7A is a side cross-sectional view of the seat adjustment mechanism of FIG. 5 in a locked configuration.
Figure 7B:
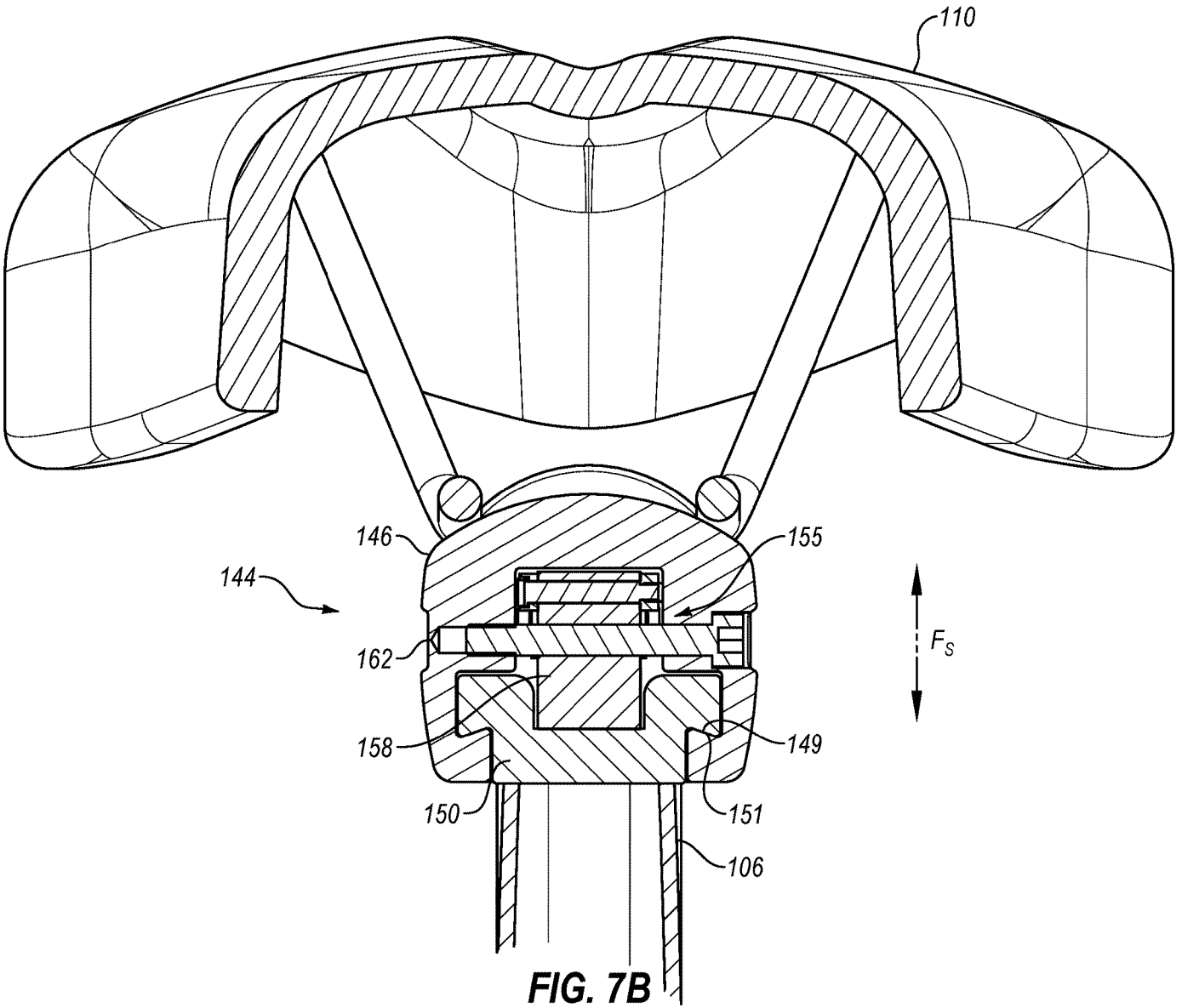
FIG. 7B is an end cross-sectional view of the seat adjustment mechanism of FIG. 5 in a locked configuration.

With particular attention to FIGS. 6A-7B, seat adjustment mechanism 144 is shown in cross-section. FIGS. 6A and 7A show side cross-sectional views of seat adjustment mechanism 144, while FIGS. 6B and 7B show end cross-sectional views thereof. As can be seen, seat adjustment mechanism 144 includes a guide frame 150 disposed at the upper end of support member 106. Guide frame 150 is maintained in a fixed position relative to support member 106. In contrast, sliding frame 146 is slidably associated with guide frame 150. More specifically, sliding frame 146 and guide frame 150 include cooperating features that enable sliding frame 146 to slide linearly relative to guide frame 150. Such cooperating features can include mating surfaces, such as dovetail surfaces 149, 151 best seen in FIGS. 6B and 7B. The sliding of sliding frame 146 relative to guide frame 150 repositions seat 110 relative to support member 106 and other portions of exercise cycle 100 (e.g. handle bar assembly 112).

To facilitate the sliding of sliding frame 146 and seat 110 forward and backward relative to guide frame 150, sliding frame 146 may be longer than the guide frame 150. Thus, as can be seen in FIGS. 6A and 7A, sliding frame 146 can extend forwardly from and/or backwardly from guide frame 150. In some embodiments, the difference in length between sliding frame 146 and guide frame 150 can be between about 2 inches and about 12 inches, or any length therebetween. As a result, the position of seat 110 can be adjusted forward or backward a distance of between about 2 inches and about 12 inches, or any length therebetween.

In some embodiments, including the embodiment illustrated in FIGS. 6A and 7A, seat adjustment mechanism 144 includes one or more stops that limit the travel of sliding frame 146 and seat 110. For instance, disposed on opposing ends of sliding frame 146 are end caps 152, 154. End caps 152, 154 can be arranged and configured so as to engage guide frame 150 once sliding frame 146 has reached a maximum forward or rearward position. By way of example, end cap 152 can engage guide frame 150 when sliding frame 146 and seat 110 have been moved to a forward most position. Similarly, end cap 154 can engage guide frame 150 when sliding frame 146 and seat 110 have been moved to a rearward most position. End caps 152, 154 can also prevent sliding frame 146 from being inadvertently removed or disengaged from guide frame 150.

As mentioned above and illustrated in FIGS. 6A-7B, seat adjustment mechanism 144 also includes a locking mechanism 155. In the illustrated embodiment, the locking mechanism 155 includes first and second cams 156, 158 disposed between sliding frame 146 and guide from 150. Cams 156, 158 are pivotally or rotatably mounted to sliding frame 146. More specifically, first cam 156 is pivotally or rotatably mounted on a rod 160 and second cam 158 is pivotally or rotatably mounted on a rod 162. Rods 160, 162 are connected between opposing walls of sliding frame 146. FIGS. 6B and 7B illustrate the connection between sliding frame 146, cam 158, and rod 162. The connection between sliding frame 146, cam 156, and rod 160 is substantially identical.

Cams 156, 158 are connected to knob 148 by a linkage 164. More specifically, knob 148 is connected to a first end of linkage 164, cam 156 is connected at an intermediate location along the length of linkage 164, and cam 158 is connected near a second end of linkage 164. Knob 148 and linkage 164 are connected together such that movement of knob 148 results in a similar movement of linkage 164. For instance, if knob 148 is moved away from sliding frame 146 (e.g., in a rearward direction), linkage 164 will similarly move is a rearward direction. Likewise, if knob 148 is moved toward sliding frame 146 (e.g., in a forward direction), linkage 164 will similarly move in a forward direction.

Cams 156, 158 and linkage 164 are connected such that movement of linkage 164 causes cams 156, 158 to rotate or pivot about rods 160, 162. For instance, when linkage 164 is moved in a first direction (e.g., forward) by way of moving knob 148 in the first direction (e.g., towards sliding frame 146), linkage 164 causes cams 156, 158 to pivot or rotate about rods 160, 162 in a first direction. Similarly, when linkage 164 is moved in a second direction (e.g., rearward) by way of moving knob 148 in the second direction (e.g., away from sliding frame 146), linkage 164 causes cams 156, 158 to pivot or rotate about rods 160, 162 in a second direction.

For instance, FIG. 6A illustrates knob 148 moved towards sliding frame 146 (e.g., in a forward direction). Such movement of knob 148 causes linkage 164 to likewise move in a forward direction, which causes cams 156, 158 to pivot or rotate about rods 160, 162. In the illustrated embodiment, linkage 164 is connected to cams 156, 158 above rods 160, 162. Accordingly, when linkage 164 moves in the forward direction, the upper portions of cams 156, 158 also move in a forward direction.

When knob 148 is moved towards sliding frame 146 as shown in FIG. 6A, cams 156, 158 are rotated so as to be oriented at least partially in the horizontal direction. More specifically, each of cams 156, 158 is shaped so as to have a first dimension that is larger than a second dimension. When cams 156, 158 are rotated to the position shown in FIG. 6A, the first dimension of each of the cams 156, 158 is oriented so that the first dimension extends at least partially in the horizontal direction and does not extend in a generally perpendicular manner between sliding frame 146 and guide frame 150.

When cams 156, 158 are rotated as shown in FIG. 6A, locking mechanism 155 is in an unlocked configuration. More specifically, rotation of cams 156, 158 to the position shown in FIG. 6A removes all or a significant portion of a spreading force applied between sliding frame 146 and guide frame 150. For instance, in some embodiments, cams 156, 158 do not contact or otherwise engage the guide frame 150 when the locking mechanism 155 is in the locked configuration. In other embodiments, the cams 156, 158 may contact or otherwise engage the guide frame 150 when the locking mechanism 155 is in the locked configuration while applying a limited spreading force between the sliding frame 146 and the guide frame 150. In any event, when the locking mechanism 155 is in the unlocked configuration, the friction between the sliding frame 146 and the guide frame 150 is reduced sufficiently to enable sliding frame 146 to slide relative to the guide frame 150, thereby allowing the position of the seat 110 to be selectively adjusted.

Locking mechanism 155 can also be placed in a locked configuration. According to the illustrated embodiment, locking mechanism 155 is moved from the unlocked configuration to the locked configuration by moving knob 148 away from sliding frame 146 (e.g., in a rearward direction) to the position shown in FIG. 7A. Such movement of knob 148 causes linkage 146 to likewise move in a rearward direction. Rearward movement of linkage 146 causes cams 156, 158 to pivot or rotate about rods 160, 162 such that the upper portions of cams 156, 158 also move in a rearward direction. Such rotation causes cams 156, 158 to be oriented more vertically (e.g., the first dimension is oriented more perpendicular relative to sliding frame 146 and guide frame 150).

Rotation of cams 156, 158 to a more vertical orientation as shown in FIG. 7A causes cams 156, 158 to contact or otherwise engage guide frame 150 in a manner that applies a spreading force between sliding frame 146 and guide frame 150. As illustrated in FIG. 7B, the spreading force $F_s$ urges sliding frame 146 and guide frame 150 away from one another. The spreading force $F_s$ causes dovetail surfaces 149, 151 to be pressed into closer contact with one another. The closer contact between dovetail surfaces 149, 151 increases the friction therebetween, which resists movement of sliding frame 146 relative to guide frame 150. As a result, seat 110 is selectively secured in place when locking mechanism 155 is in the locked configuration. In contrast, when locking mechanism 155 is in the unlocked configuration (FIGS. 6A and 7A), cams 156, 158 create no or a minimal spreading force between sliding frame 146 and guide frame 150, thereby reducing the friction between dovetail surfaces 149, 151. The reduced friction allows sliding frame 146 to move relative to guide frame 150, which allows seat 110 to be selectively repositioned as desired.

As can be seen in FIGS. 6A and 7A, cams 156, 158 are spaced apart from one another between the front and rear ends of seat adjustment mechanism 144. Such spacing can provide stability to seat adjustment mechanism 144 and seat 110. In particular, spacing cams 156, 158 apart from one another can limit or prevent sliding frame 146 from teetering or rocking, thereby holding seat 110 in a more secure and stable position. In the illustrated embodiment, cams 156, 158 are spaced apart by about 2.5 inches. In other embodiments, cams 156, 158 can be spaced apart by between about 1 inch and about 12 inches, between about 2 inches and about 10 inches, between about 1.5 inches and about 6 inches, or any distance within the foregoing ranges.

Figure 8:
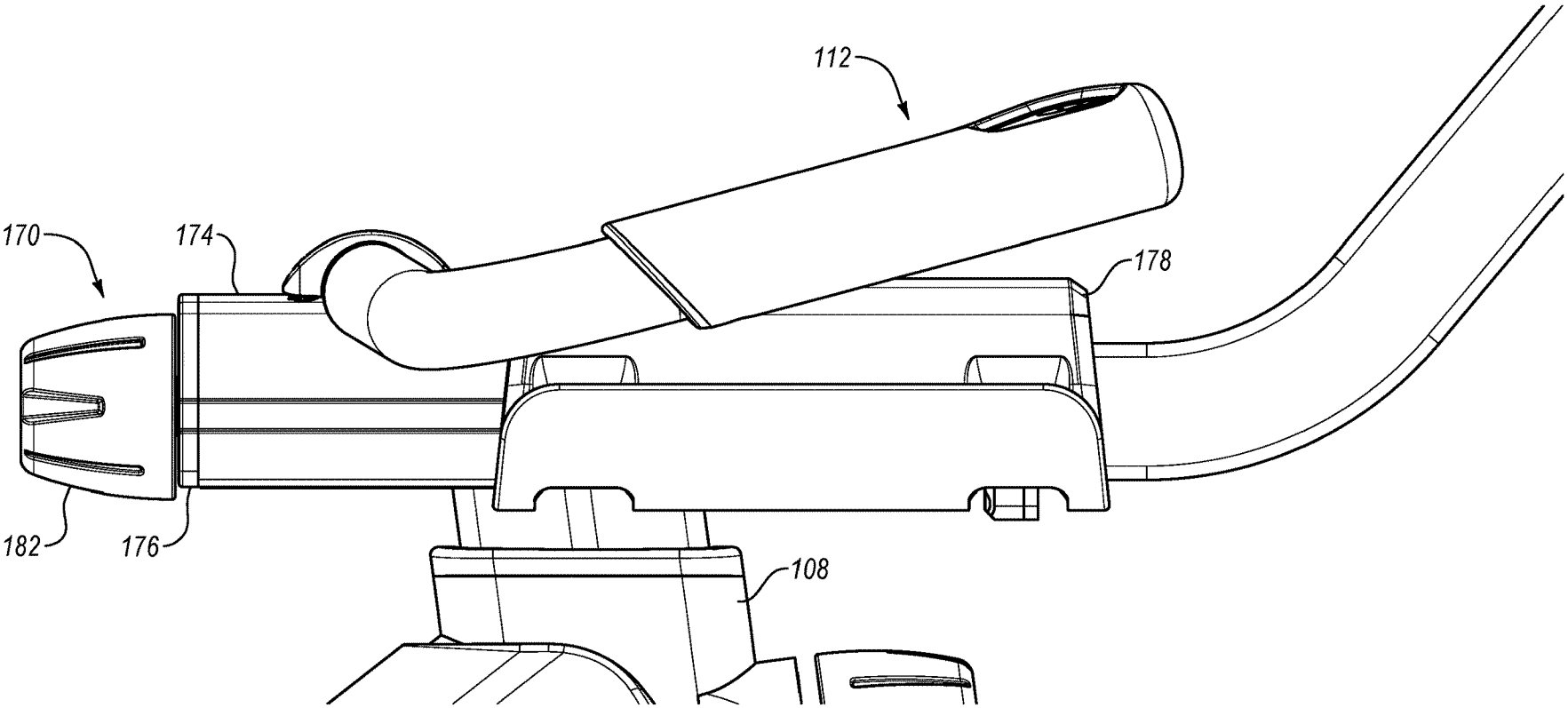
FIG. 8 is a side view of a handle adjustment mechanism.
Figure 9:
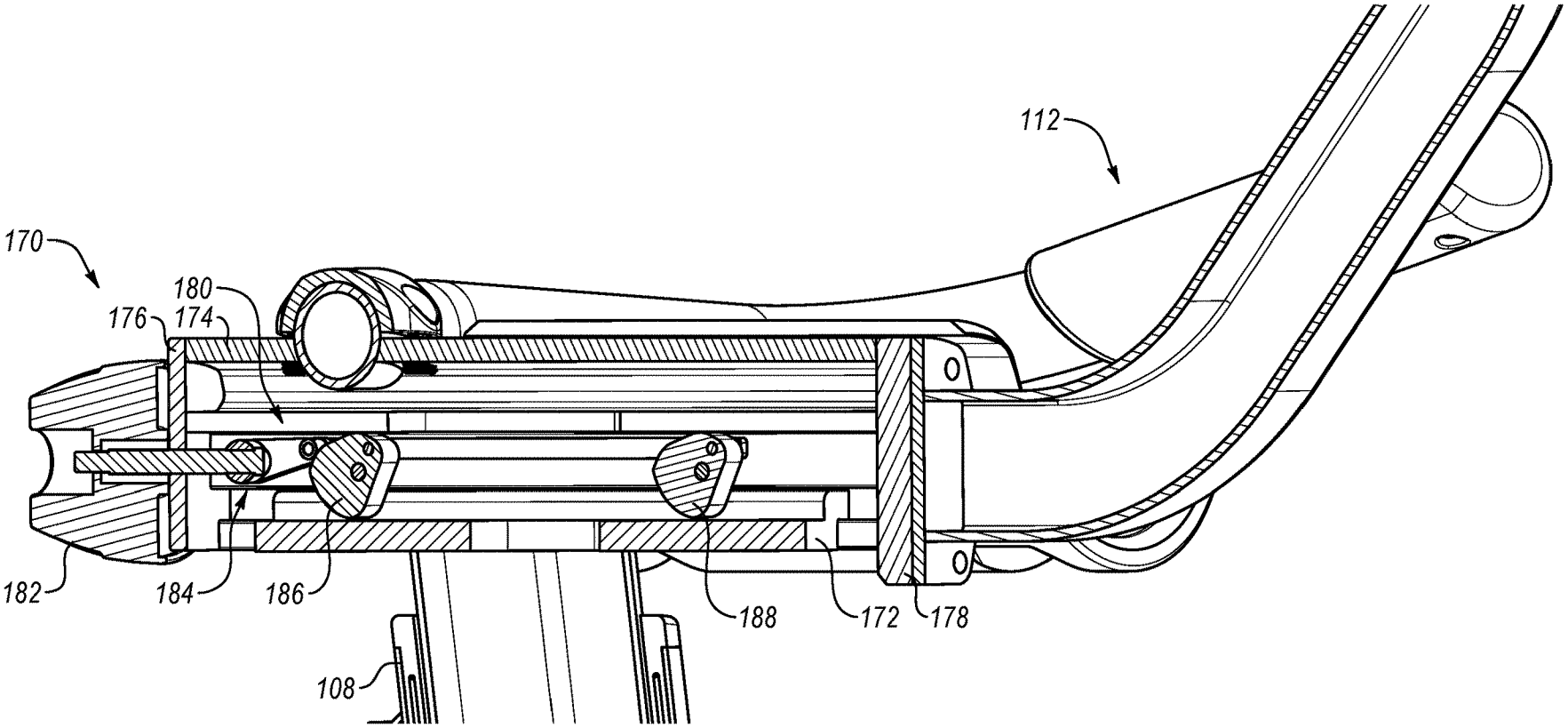
FIG. 9 is a side cross-sectional view of the seat adjustment mechanism of FIG. 10.
Figure 10:
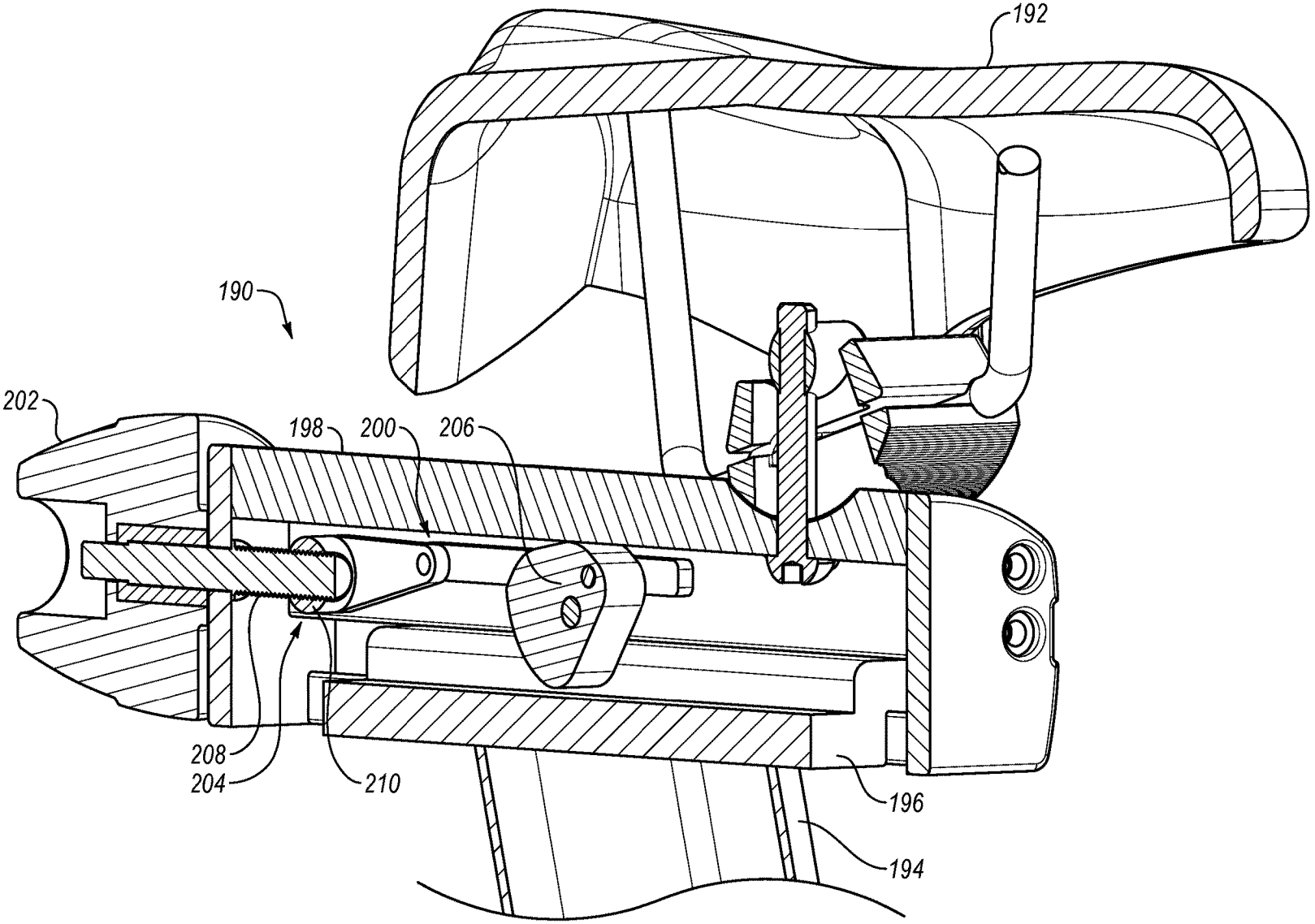
FIG. 10 is a side cross-sectional view of another adjustment mechanism.

Attention is now directed to FIGS. 8 and 9, which illustrate a handle bar adjustment mechanism 170. In particular, FIG. 8 illustrates a side view of handle bar adjustment mechanism 170 and FIG. 9 illustrates a side cross-sectional view thereof. Handle bar adjustment mechanism 170 enables handle bar assembly 112 to be selectively repositioned forward or backward similar to the adjustment of seat 110 discussed above. Additionally, other than having handle bar assembly 112 mounted thereon instead of seat 110, handle bar adjustment mechanism 170 can be similar or identical to seat adjustment mechanism 144 discussed above.

For instance, handle bar adjustment mechanism 170 includes a guide frame 172 mounted on support member 108 is a fixed manner. Handle bar adjustment mechanism 170 also includes a sliding frame 174 movably or slidably mounted on guide frame 172. Sliding frame 174 includes end caps 176, 178 disposed at opposing ends thereof to limit the travel of sliding frame 174 relative to guide frame 172 and/or to prevent removal of sliding frame 174 from guide frame 172.

Handle bar adjustment mechanism 170 also includes a locking mechanism 180 that can be moved between a locked configuration and an unlocked configuration. When locking mechanism 180 is in the locked configuration, sliding frame 174 is secured in place relative to guide frame 172. As a result, handle bar assembly 112 is also secured in place. In contrast, when locking mechanism 180 is in the unlocked configuration, sliding frame 174 is able to move relative to guide frame 172. Movement of handle bar assembly 112 is directly linked to movement of sliding frame 174. Thus, movement of sliding frame 174 repositions handle bar assembly 112. Once handle bar assembly 112 is (re)positioned as desired, locking mechanism 180 can be moved to the locked configuration to secure handle bar assembly 112 is the desired position.

Similar to locking mechanism 155 of seat adjustment mechanism 144, locking mechanism 180 includes a knob 182, a linkage 184, and cams 186, 188. Cams 186, 188 are disposed between guide frame 172 and sliding frame 174 and are connected to knob 182 by linkage 184. Knob 182 can be moved relative to sliding frame 174, which moves linkage 184 and rotates cams 186, 188.

When locking mechanism 180 is in the locked configuration, cams 186, 188 are rotated to apply a spreading force against guide frame 172 and sliding frame 174. The spreading force increases the friction between guide frame 172 and sliding frame 174, thereby restricting movement of sliding frame 174 relative to guide frame 172. In contrast, when locking mechanism 180 is in the unlocked configuration, cams 186, 188 are rotated to remove or reduce the spreading force applied between guide frame 172 and sliding frame 174. The reduced spreading force reduces the friction between guide frame 172 and sliding frame 174, thereby allowing sliding frame 174 (and connected handle bar assembly 112) to move relative to guide frame 172.

As can be seen in FIG. 11, cams 186, 188 are spaced apart from one another between the front and rear ends of handle bar adjustment mechanism 170. Such spacing can provide stability to handle bar adjustment mechanism 170 and handle bar assembly 112. In particular, spacing cams 186, 188 apart from one another can limit or prevent sliding frame 174 from teetering or rocking, thereby holding handle bar assembly 112 in a more secure and stable position. In the illustrated embodiment, cams 186, 188 are spaced apart by about 2.5 inches. In other embodiments, cams 186, 188 can be spaced apart by between about 1 inch and about 12 inches, between about 2 inches and about 10 inches, between about 1.5 inches and about 6 inches, or any distance within the foregoing ranges.

Attention is now directed to FIG. 110, which illustrates an adjustment mechanism 190 that is similar to adjustment mechanisms 144 and 170 discussed herein. Because adjustment mechanism 190 is similar or identical to adjustment mechanisms 144 and 170 in many respects, the following discussion will focus on the unique aspects of adjustment mechanism 190. Before proceeding further, it will be noted that while adjustment mechanism 190 is shown connected between a seat 192 and a support member 194 similar to adjustment mechanism 144, adjustment mechanism 190 may similarly be connected between a support member and a handle bar assembly similar to adjustment mechanism 170.

Adjustment mechanism 190 includes a guide frame 196 and a sliding frame 198 that can be similar or identical to the other guide frames and sliding frames described herein. Adjustment mechanism 190 also includes a locking mechanism 200 for selectively securing sliding frame 198 in place relative to guide frame 196. Locking mechanism 200 includes an adjustment knob 202, a linkage 204, and a cam 206. Cam 206 is rotatable between a locked position and an unlocked position to either apply or remove a spreading force from guide frame 196 and sliding frame 198.

One distinction between adjustment mechanism 190 and the other adjustment mechanism described herein is that adjustment mechanism 190 includes a single cam 206, rather than multiple spaced apart cams. Additionally, cam 206 is moved between the unlocked and locked positions by rotation of knob 202, rather than through linear movement as with the other adjustment mechanisms described herein. In the illustrated embodiment, linkage 204 includes a lead screw 208 and a follower 210. Lead screw 208 and knob 202 are connected such that rotation of knob 202 results in a corresponding rotation of lead screw 208. Following 210 is mounted on lead screw 208 such that rotation of lead screw 208 causes follower 210 to move linearly. In turn, follower 210 is connected to cam 206 such that linear movement of follower 210 causes cam 206 to rotate between the locked and unlocked positions.

INDUSTRIAL APPLICABILITY

In general, embodiments of the present disclosure relate to exercise cycles that can be selectively adjusted to accommodate different exercises or users. For instance, an exercise cycle may have an adjustable incline mechanism for allowing a portion of the exercise cycle to have a forward incline simulating a descent down a hill, or a rear incline to simulate an ascent up a hill. By way of example, the exercise cycle can include an upright support structure pivotally connected to a support base. An incline mechanism connected between the support base and the upright support structure can cause the upright support structure to pivot between various tilted and neutral positions.

In some embodiments, the upright support structure includes first and second support members. In some cases, the first support member has a seat mounted thereon and the second support member has a set of handles or a handle bar assembly mounted thereon. Additionally, in some embodiments, the first support member is pivotally connected to the base support, while the second support member is connected to and extends from the first support member. In some cases, the pivotal connection between the upright support structure and/or the first support member thereof and the support base includes one or more stops to limit the tilting of the upright support structure within a desired range. Pivotal connection can, in some embodiments, include a ball joint allowing the upright support structure to tilt forward or backward relative to the floor or other support surface, or even tilt from side-to-side.

The incline mechanism can be connected between the support base and the first support member such that the incline mechanism can apply forces therebetween to pivot the upright support structure relative to the support base. The incline mechanism can be any linearly extending mechanism, such as a rotating or threaded drive shaft, a rod and piston assembly or other pneumatic or hydraulic actuator, a rack and pinion assembly, or any other extension mechanism.

In some embodiments, the incline mechanism is pivotally connected to one or both of the support base and the upright support structure (or the first support member thereof). Additionally, the incline mechanism can be connected between the support base and the upright support structure such that the incline mechanism and the second support member are generally aligned with one another or extend generally parallel to one another.

The exercise cycle can also include a resistance mechanism that increases or decreases the effort required of the user to rotate the pedals of the exercise cycle. The resistance mechanism can take a variety of forms. For instance, the resistance mechanism may include a magnetic brake (e.g., eddy brake), a frictional brake, an electromechanical brake, or any other suitable mechanism.

In some embodiments, the support base, the upright support structure, the pivot, and the incline mechanism have unique spatial arrangements relative to one another. Some of the spatial arrangements provide improved performance or functionality to the exercise cycle. For instance, a pivot is disposed directly or substantially below the center of gravity of the upright support structure and/or a user riding on exercise cycle. Such placement of the pivot can reduce or minimize the load supported by an incline mechanism and the force required of the incline mechanism to tilt the upright support structure.

In some embodiments, an incline mechanism is pivotally connected to the support base such that the incline mechanism and the support base form an angle of about 35° when upright support structure is in the neutral position described above. In some embodiments, when upright support structure is in the neutral position, incline mechanism and support base form an angle of between about 10° and about 70°, between about 20° and about 60°, between about 25° and about 55°, between about 30° and about 50°, or any angle within the foregoing ranges.

Similarly, the support member of the upright support structure may be connected to the support base such that the support member and the support base form an angle of about 75° when upright support structure is in the neutral position described above. In some embodiments, when upright support structure is in the neutral position, the support member and the support base form an angle of between about 25° and about 90°, between about 35° and about 85°, between about 45° and about 80°, between about 60° and about 80°, or any angle within the foregoing ranges.

Further, the support member of the upright support structure may be connected to the incline mechanism such that the support member and the incline mechanism form an angle of about 70° when the upright support structure is in the neutral position described above. In some embodiments, when the upright support structure is in the neutral position, the support member and incline mechanism form an angle of between about 25° and about 90°, between about 35° and about 85°, between about 45° and about 80°, between about 60° and about 80°, or any angle within the foregoing ranges.

In some embodiments, the exercise cycle can include a console that can be used while riding on the exercise cycle or while performing other activities not on the exercise cycle. For instance, the console can be adjustably connected to the upright support structure so that a user on the exercise cycle can adjust the orientation of the console to a position or angle desirable for viewing while the user is riding on the exercise cycle. Such adjustments may include tilting the console up or down (e.g., to remove glare, etc.).

The console can also be adjustably connected to the upright support structure so that a user can rotate the console for use when the user is not riding on the exercise cycle. For instance, the user may rotate the console in a horizontal plane or about a vertical axis so that the console faces away from a seat on the exercise cycle. When the console is rotated away from the seat, the user can view content on the console while the user performs other activities.

For instance, an exercise routine may call for the user to ride on the exercise cycle for a specified time or distance. The exercise routine may also call for the user to perform one or more exercises other than riding on the exercise cycle. Such exercises may include aerobic exercises, strength training exercises, balance exercises, and the like. In some cases, the console may provide instructions to the user for performing the additional exercises. To enable the user to view the instructions while performing the exercises, the console can be rotated away from the exercise cycle seat and towards an area adjacent to the exercise cycle where the user can perform the exercises.

Example exercise cycles also allow for the adjustment of the exercise cycle seat and/or handles/handle bar assembly. For instance, an exercise cycle can include an adjustment mechanism for the seat, an adjustment mechanism for the handles/handle bar assembly, or an adjustment mechanism for each of the seat and the handles/handle base assembly. In some cases, the adjustment mechanisms for the seat and the handles/handle bar assembly can be substantially identical to one another.

Such adjustment mechanism can include a guide frame fixedly mounted on the upright support structure. A sliding frame can be slidably mounted on the guide frame for movement between forward and rearward positions relative to the guide frame. The seat or handles/handle bar assembly (depending on whether the adjustment mechanism is used with the seat or the handles/handle bar assembly) can be secured to the sliding frame such that movement of the sliding frame results in movement of the seat or handles/handle bar assembly.

The adjustment mechanism can include a locking mechanism that selectively secures the sliding frame (and the associated seat or handles/handle bar assembly) in place or allows the sliding frame (and the associated seat or handles/handle bar assembly) to be moved to a desired position. The locking mechanism can include one or more cams disposed between the sliding frame and the guide frame. In some embodiments, the one or more cams are pivotally or rotatably connected to the sliding frame. In other embodiments, the one or more cams are pivotally connected to the guide frame.

Connected to the one or more cams are a linkage and a knob. The one or more cams are pivotally connected to the linkage such that movement of the linkage causes the one or more cams to rotate. The linkage, in turn, is connected to the knob such that movement of the knob results in movement of the linkage and the one or more cams. In some embodiments, the knob moves linearly (e.g., in a sliding manner) to move the linkage and the one or more cams. In other embodiments, the knob can be rotated to cause the movement of the linkage and the one or more cams. For instance, the knob and the linkage may be connected with a lead screw and follower. Rotation of the knob may rotate the lead screw, which in turn moves the follower and the linkage linearly and causes the one or more cams to rotate.

The one or more cams can be rotated between locked and unlock positions. In the locked position, the one or more cams engage the guide frame and the sliding frame in a manner that applies a spreading force therebetween. The spreading force causes the cooperating features, such as mating dovetails surfaces, of the guide frame and the sliding frame to be pressed into closer contact with one another. The closer contact between the cooperating features increases the friction therebetween, thereby restricting movement of the sliding frame (and the associated seat or handles/handle bar assembly) relative to the guide frame.

In contrast, when the one or more cams are rotated to the unlocked position, the spreading force applied by the one or more cams to the guide frame and the sliding frame is reduced or eliminated. As a result, the friction between the cooperating features is also reduced or eliminated, thereby allowing the sliding frame (and the associated seat or handles/handle bar assembly) to move relative to the guide frame.

As noted, the locking mechanism can include one or more cams. The use of a single cam can adequately secure the sliding frame (and the associated seat or handles/handle bar assembly) in place. In some instances, however, it can be desirable to use two or more cams as part of the locking mechanism. Using two or more cams can limit or prevent the sliding frame (and the associated seat or handles/handle bar assembly) from teetering, deflecting, bending, flexing, or rocking (e.g., relative to the cam or the guide frame). Additionally, using two or more cams can improve the connection between the guide frame and the sliding frame. Furthermore, using two or more cams can increase and/or more evenly distribute the spreading force applied between the guide frame and the sliding frame along the length of the guide frame and the sliding frame. The distribution of the spreading force can extend the life of the components by minimizing or preventing localized stresses during use of the exercise cycle.

In embodiments that include a first cam and a second cam, the cams may be spaced apart from one another between the front and rear ends of the seat or handle bar adjustment mechanism. Such spacing may provide improved stability to the seat or handle bars relative to the frame. In other words, proper spacing of the cams apart from one another can limit or prevent the sliding frame from teetering or rocking, thereby holding the seat or handle bars in a more secure and stable position. In some embodiments, the cams may be spaced apart by about 2.5 inches. In other embodiments, the first and second cams may be spaced apart by between about 1 inch and about 12 inches, between about 2 inches and about 6 inches, between about 1.5 inches and about 4 inches, or any distance within the foregoing ranges.

Alternatively, the adjustment mechanism may include a single cam, rather than multiple spaced apart cams.

In general, embodiments of the invention may be described as outlined in the following sections.

1. An exercise cycle, comprising:
   - a frame configured to rest upon a support surface;
   - at least one of:
   - a handle bar assembly configured to be held during use of the exercise cycle, the handle bar assembly being connected to the frame; or
   - a seat configured to support a user during use of the exercise cycle, the seat being connected to the frame; and an adjustment mechanism for selectively adjusting the position of the handle bar assembly or the seat relative to the frame, the adjustment mechanism comprising:
   - a guide frame fixedly secured to the frame;
   - a sliding frame slidably mounted on the guide frame, the handle bar assembly or the seat being mounted on the sliding frame; and
   - one or more cams pivotally disposed between the guide frame and the sliding frame, the one or more cams being rotatable between an unlocked position and a locked position, the one or more cams restricting movement of the sliding frame when the one or more cams are in the locked position and allowing the sliding frame to move relative to the guide frame when the one or more cams are in the unlocked position.

2. An exercise cycle as outlined in section 1, wherein the adjustment mechanism further comprises a linkage and an adjustment knob.

3. An exercise cycle as outlined in section 2, wherein the one or more cams are pivotally connected to the linkage.

4. An exercise cycle as outlined in any of sections 1-3, wherein the knob can be selectively engaged to cause the one or more cams to rotate between the locked and unlocked positions.

5. An exercise cycle as outlined in any of sections 1-4, wherein the handle bar assembly or the seat is fixedly secured to the sliding frame such that movement of the sliding frame results in corresponding movement of the handle bar assembly or the seat.

6. An exercise cycle as outlined in any of sections 1-5, wherein the one or more cams include a first cam and a second cam that are aligned with one another between a front end and a rear end of the adjustment mechanism.

7. An exercise cycle as outlined in any of sections 1-6, wherein the guide frame and the sliding frame include mating surfaces.

8. An exercise cycle as outlined in section 7, wherein rotation of the one or more cams to the locked position increases a level of friction between the mating surfaces.

9. An exercise cycle as outlined in section 7 or 8, therein the mating surface comprising mating dovetail surface.

10. An exercise cycle as outlined in any of sections 1-9, wherein the adjustment mechanism include one or more stop to limit the movement of the sliding frame relative to the guide frame.

11. An exercise cycle as outline in section 10, wherein the one or more stop comprise a first end cap connected to a first end of the sliding frame and a second end cap connected to the second end of the sliding frame.

12. An exercise cycle as outlined in any of sections 1-11, wherein the sliding frame is longer than the guide frame.

13. An exercise cycle as outlined in any of sections 1-12, wherein the one or more cams comprise at least two cams that are spaced apart from one another by about 2.5 inches.

14. An exercise cycle as outlined in any of sections 1-12, wherein the one or more cams comprise at least two cams that are spaced apart from one another by between about 1 inch and about 12 inches, between about 2 inches and about 10 inches, or between about 1.5 inches and about 6 inches.

15. An exercise cycle, comprising:

a frame configured to rest upon a support surface;

a handle bar assembly configured to be held during use of the exercise cycle, the handle bar assembly being connected to the frame; and an adjustment mechanism for selectively adjusting the position of the handle bar assembly relative to the frame, the adjustment mechanism comprising:

a guide frame fixedly secured to the frame;

a sliding frame slidably mounted on the guide frame, the handle bar assembly being mounted on the sliding frame;

one or more cams pivotally disposed between the guide frame and the sliding frame, the one or more cams being rotatable between an unlocked position and a locked position, the one or more cams restricting movement of the sliding frame when the one or more cams are in the locked position and allowing the sliding frame to move relative to the guide frame when the one or more cams are in the unlocked position.

16. An exercise cycle as outlined in section 15, wherein the adjustment mechanism further comprises a linkage and an adjustment knob.

17. An exercise cycle as outlined in section 16, wherein the one or more cams are pivotally connected to the linkage.

18. An exercise cycle as outlined in section 17, wherein the knob can be selectively engaged to cause the one or more cams to rotate between the locked and unlocked positions.

19. An exercise cycle as outlined in any of sections 15-18, wherein the handle bar assembly is fixedly secured to the sliding frame such that movement of the sliding frame results in corresponding movement of the handle bar assembly.

20. An exercise cycle as outlined in any of sections 15-19, wherein the one or more cams include a first cam and a second cam that are aligned with one another between a front end and a rear end of the adjustment mechanism.

21. An exercise cycle as outlined in any of sections 15-20, wherein the guide frame and the sliding frame include mating surfaces.

22. An exercise cycle as outlined in section 21, wherein rotation of the one or more cams to the locked position increases a level of friction between the mating surfaces.

23. An exercise cycle as outlined in section 21 or 22, therein the mating surface comprising mating dovetail surface.

24. An exercise cycle as outlined in any of sections 15-23, wherein the adjustment mechanism include one or more stop to limit the movement of the sliding frame relative to the guide frame.

25. An exercise cycle as outline in section 24, wherein the one or more stop comprise a first end cap connected to a first end of the sliding frame and a second end cap connected to the second end of the sliding frame.

26. An exercise cycle as outlined in any of sections 15-25, wherein the sliding frame is longer than the guide frame.

27. An exercise cycle, comprising:

a frame configured to rest upon a support surface;

a seat configured to support a user during use of the exercise cycle, the seat being connected to the frame; and an adjustment mechanism for selectively adjusting the position of the seat relative to the frame, the adjustment mechanism comprising:

a guide frame fixedly secured to the frame;

a sliding frame slidably mounted on the guide frame, the seat being mounted on the sliding frame;

one or more cams pivotally disposed between the guide frame and the sliding frame, the one or more cams being rotatable between an unlocked position and a locked position, the one or more cams restricting movement of the sliding frame when the one or more cams are in the locked position and allowing the sliding frame to move relative to the guide frame when the one or more cams are in the unlocked position.

28. An exercise cycle as outlined in section 27, wherein the adjustment mechanism further comprises a linkage and an adjustment knob.

29. An exercise cycle as outlined in section 28, wherein the one or more cams are pivotally connected to the linkage.

30. An exercise cycle as outlined in section 29, wherein the knob can be selectively engaged to cause the one or more cams to rotate between the locked and unlocked positions.

31. An exercise cycle as outlined in any of sections 27-30, wherein the seat is fixedly secured to the sliding frame such that movement of the sliding frame results in corresponding movement of the seat.

32. An exercise cycle as outlined in any of sections 27-31, wherein the one or more cams include a first cam and a second cam that are aligned with one another between a front end and a rear end of the adjustment mechanism.

33. An exercise cycle as outlined in any of sections 27-32, wherein the guide frame and the sliding frame include mating surfaces.

34. An exercise cycle as outline in section 33, wherein rotation of the one or more cams to the locked position increases a level of friction between the mating surfaces.

35. An exercise cycle as outlined in section 33 or 34, therein the mating surface comprising mating dovetail surface.

36. An exercise cycle as outlined in any of sections 27-34, wherein the adjustment mechanism include one or more stop to limit the movement of the sliding frame relative to the guide frame.

37. An exercise cycle as outlined in section 36, wherein the one or more stop comprise a first end cap connected to a first end of the sliding frame and a second end cap connected to the second end of the sliding frame.

38. An exercise cycle as outlined in any of sections 27-37, wherein the sliding frame is longer than the guide frame.

39. An exercise cycle, comprising:

a frame configured to rest upon a support surface;

a console mounted to the frame, the console comprising a display; and a pivot assembly pivotally connecting the console to the frame, the pivot assembly enabling the console to rotate at least 90° about a generally vertical axis.

40. An exercise cycle as outlined in section 39, wherein the pivot assembly enables the console to rotate at least 180° about the generally vertical axis.

41. An exercise cycle as outlined in any of sections 39-40, wherein the pivot assembly enables the console to rotated at least 180° about a generally horizontal axis.

42. A method of performing an exercise routine, the method comprising:

riding on an exercise cycle; and rotating a console of the exercise cycle at least 90° in a first direction about a generally vertical axis; and performing one or more exercises while viewing exercise instructions on the rotated console of the exercise device.

43. A method as outlined in section 42, further comprising rotating the console of the exercise at least 90° in a second direction about the generally vertical axis, the second direction being opposite to the first direction.

44. A method as outlined in section 43, further comprising rotating the console of the exercise at least 90° in the first direction about the generally vertical axis and performing one or more additional exercises while viewing exercise instructions on the rotated console of the exercise device.

45. An exercise cycle, comprising:

a support base configured to rest upon a support surface;

an upright support structure, the upright support structure comprising a first support member pivotally connected to the support base and a second support member connected to the first support member;

a handle bar assembly mounted on the second support member; and an incline mechanism configured to selectively vary a pitch of the upright support structure relative to the support base, the incline mechanism being connected between the support base and the first support member, the incline mechanism being aligned with or extending generally parallel to the second support member.

46. An exercise cycle as outlined in section 45, wherein a first end of the incline mechanism is pivotally connected to the first support member.

47. An exercise cycle as outlined in section 45 or 46, wherein a second end of the incline mechanism is pivotally connected to the support base.

48. An exercise cycle as outline in section 47, wherein the second end of the incline mechanism is connected to a rear end of the support base.

49. An exercise cycle as outlined in any of sections 45-48, wherein the incline mechanism comprises a linearly extending mechanism.

50. An exercise cycle as outlined in section 49, wherein the linearly extending mechanism comprises at least one of a rotating or threaded drive shaft, a rod and piston assembly, a pneumatic actuator, a hydraulic actuator, or a rack and pinion assembly.

What is claimed is:

1. An exercise cycle, comprising:

a frame configured to rest upon a support surface;

at least one of:

a handle bar assembly configured to be held during use of the exercise cycle, the handle bar assembly being connected to the frame; or a seat configured to support a user during use of the exercise cycle, the seat being connected to the frame; and an adjustment mechanism for selectively adjusting a position of the handle bar assembly or the seat relative to the frame, the adjustment mechanism comprising:

a guide frame fixedly secured to the frame;

a sliding frame slidably mounted on the guide frame, the handle bar assembly or the seat being mounted on the sliding frame; and at least one cam pivotally disposed between a cam contact surface of the guide frame and a cam contact surface of the sliding frame, wherein the at least one cam includes a first dimension and a second dimension, the first dimension being longer than the second dimension the at least one cam being rotatable between an unlocked position and a locked position, wherein in the locked position, the first dimension is oriented transverse between the guide frame and the sliding frame and the at least one cam restricts movement of the sliding frame, and wherein in the unlocked position, the first dimension extends at least partially in a horizontal direction and the at least one cam allows the sliding frame to move relative to the guide frame when the one or more cams are in the unlocked position, wherein the at least one cam is in contact with both cam contact surfaces when in a locked position.

2. The exercise cycle of claim 1, wherein the adjustment mechanism further comprises a linkage and an adjustment knob.

3. The exercise cycle of claim 2, wherein the at least one cam is pivotally connected to the linkage such that as the linkage moves horizontally the at least one cam pivots.

4. The exercise cycle of claim 3, wherein the adjustment knob can be selectively engaged to cause the at least one cam to rotate between the locked and unlocked positions.

5. The exercise cycle of claim 1, wherein the handle bar assembly or the seat is fixedly secured to the sliding frame such that movement of the sliding frame results in corresponding movement of the handle bar assembly or the seat.

6. The exercise cycle of claim 1, wherein the at least one cam includes a first cam and a second cam that are aligned with one another between a front end and a rear end of the adjustment mechanism.

7. The exercise cycle of claim 1, wherein the guide frame and the sliding frame include mating surfaces.

8. The exercise cycle of claim 7, wherein rotation of the at least one cam to the locked position increases a level of friction between the mating surfaces.

9. The exercise cycle of claim 7, wherein the mating surface comprises mating dovetail surface.

10. The exercise cycle of claim 1, wherein the adjustment mechanism include one or more stops to limit the movement of the sliding frame relative to the guide frame.

11. The exercise cycle of claim 10, wherein the one or more stops comprise a first end cap connected to a first end of the sliding frame and a second end cap connected to a second end of the sliding frame.

12. The exercise cycle of claim 1, wherein the sliding frame is longer than the guide frame.

13. The exercise cycle of claim 1, wherein the at least one cam comprises two cams that are spaced apart from one another by about 2.5 inches.

14. The exercise cycle of claim 1, wherein the at least one cam comprises two cams that are spaced apart from one another by between about 1 inch and about 12 inches, between about 2 inches and about 10 inches, or between about 1.5 inches and about 6 inches.

15. The exercise cycle of claim 1, wherein in the locked position, the first dimension is perpendicular to the guide frame and the sliding frame.

16. An exercise cycle, comprising:

a frame including a support base configured to rest upon a support surface and an upright support structure, the upright support structure comprising a first support member pivotally connected to the support base and a second support member connected to the first support member;

a console mounted to the frame, the console comprising a display;

a pivot assembly pivotally connecting the console to the frame, the pivot assembly enabling the console to rotate at least 90° about a generally vertical axis;

a handle bar assembly configured to be held during use of the exercise cycle, the handle bar assembly mounted on the second support member;

an incline mechanism configured to selectively vary a pitch of the upright support structure relative to the support base, the incline mechanism being connected between the support base and the first support member, the incline mechanism being aligned with or extending generally parallel to the second support member;

a seat configured to support a user during use of the exercise cycle, the seat being connected to the frame; and an adjustment mechanism for selectively adjusting a position of the seat relative to the frame, the adjustment mechanism comprising:

a guide frame fixedly secured to the frame;

a sliding frame slidably mounted on the guide frame, the seat being mounted on the sliding frame; and at least one cam pivotally disposed between the guide frame and the sliding frame, the at least one cam being rotatable between an unlocked position and a locked position, the at least one cam restricting movement of the sliding frame when the at least one cam is in the locked position, wherein the at least one cam restricts movement of the sliding frame such that a single cam of the at least one cam extends a spreading force between the guide frame and the sliding frame, and wherein the at least one cam allows the sliding frame to move relative to the guide frame when the at least one cam is in the unlocked position.

17. An exercise cycle, comprising:

a frame configured to rest upon a support surface;

at least one of:

a handle bar assembly configured to be held during use of the exercise cycle, the handle bar assembly being connected to the frame; or a seat configured to support a user during use of the exercise cycle, the seat being connected to the frame; and an adjustment mechanism for selectively adjusting a position of the handle bar assembly or the seat relative to the frame, the adjustment mechanism comprising:

a guide frame fixedly secured to the frame;

a sliding frame slidably mounted on the guide frame, the handle bar assembly or the seat being mounted on the sliding frame; and a first cam pivotally disposed between the guide frame and the sliding frame about a first rod;

a second cam pivotally disposed between the guide frame and the sliding frame about a second rod; and a linkage connected to a knob at a linkage first end, the first cam at an intermediate linkage location, and the second cam at a linkage second end, wherein the adjustment mechanism is movable between a locked configuration and an unlocked configuration, and wherein movement of the knob causes the first cam to pivot about the first rod and the second cam to pivot about the second rod between the locked configuration and the unlocked configuration.

18. The exercise cycle of claim 17, wherein the movement of the knob is a linear movement in a forward direction and a backward direction.

19. The exercise cycle of claim 18, wherein the movement of the knob in the forward direction causes a first upper portion of the first cam and a second upper portion of the second cam to move in a forward direction, and wherein the movement of the knob in the backward direction causes the first upper portion and the second upper portion to move in a backward direction.

20. The exercise cycle of claim 17, wherein the first cam is pivotally connected to the linkage and the second cam is pivotally connected to the linkage.

* * * * *